US005357779A

United States Patent [19]

Hahn et al.

[11] Patent Number: 5,357,779

[45] Date of Patent: * Oct. 25, 1994

[54] CAN BODY MAKER WITH MAGNETIC RAM BEARING AND REDRAW ACTUATOR

[75] Inventors: Roger A. Hahn, Arvada; Phillip W. Gold, Lakewood; Harold Cook, Jr., Evergreen, all of Colo.

[73] Assignee: Coors Brewing Company, Golden, Colo.

[ * ] Notice: The portion of the term of this patent subsequent to Nov. 2, 2010 has been disclaimed.

[21] Appl. No.: 36,179

[22] Filed: Mar. 23, 1993

Related U.S. Application Data

[63] Continuation-in-part of Ser. No. 912,811, Jul. 13, 1992, Pat. No. 5,257,523, which is a continuation-in-part of Ser. No. 724,881, Jul. 2, 1991, abandoned, which is a continuation-in-part of Ser. No. 578,938, Sep. 7, 1990, abandoned, and Ser. No. 871,400, Apr. 21, 1992, abandoned, which is a continuation of Ser. No. 578,938, Sep. 7, 1990, abandoned.

[51] Int. Cl.[5] ..... B21D 24/10

[52] U.S. Cl. ..... 72/347; 72/430

[58] Field of Search ..... 72/347, 349, 350, 351, 72/361, 430; 100/917; 310/14, 15

[56] References Cited

U.S. PATENT DOCUMENTS

| | | | |
|---|---|---|---|
| 1,606,141 | 11/1926 | Brown | 72/430 |
| 2,951,437 | 9/1960 | Diener | 100/917 |
| 3,441,819 | 4/1969 | Palmero | 310/15 |
| 3,584,496 | 6/1971 | Keller | 72/430 |
| 3,696,657 | 10/1972 | Maytag . | |
| 3,704,619 | 12/1972 | Paramonoff | 72/349 |

(List continued on next page.)

FOREIGN PATENT DOCUMENTS

| | | |
|---|---|---|
| 24842 | 10/1922 | France . |
| 453220 | 12/1974 | U.S.S.R. . |

OTHER PUBLICATIONS

Pamphlet entitled "Linear Induction Motors" of Northern Magnetics, Inc., Van Nuys, Calif., pp. 1–6.

Pamphlet by Northern Magnetics, Inc., Van Nuys, Calif., pp. 11–13 and 15–17.

Design Bulletin No. 4 of Northern Magnetics, Inc., Van Nuys, Calif. (1–78), pp. 1–13 and Tables.

Technical bulletin #769–3 of Northern Magnetics, Inc., Van Nuys, Calif.

Article entitled "Linear Induction: A New Way to Go," *Mechanix Illustrated* (Dec. 1975), pp. 38–40.

*Primary Examiner*—Lowell A. Larson

*Attorney, Agent, or Firm*—Klaas, Law, O'Meara & Malkin

[57] ABSTRACT

A can body maker apparatus including a stationary support frame; a housing having forming and ironing dies located therein mounted on the support frame; an elongated ram; a reciprocating ram drive; and a redraw assembly which includes a redraw sleeve for supporting a can body preform thereon; a redraw carriage for supporting and axially displacing the redraw sleeve relative the ram; a redraw electromagnetic coil fixedly positioned relative the stationary support frame; and a permanent magnet fixedly mounted with respect to the redraw carriage in displace relationship with the coil along the coil axis for co-acting with the electromagnetic field produced by the coil for controllably reciprocatingly displacing the redraw carriage. Also, apparatus is provided for applying a force on the redraw sleeve while the redraw sleeve is in contact with the can body preform so that the redraw sleeve applies a pressure on the can body preform and control apparatus for controlling the amount of force applied on the redraw sleeve.

20 Claims, 18 Drawing Sheets

U.S. PATENT DOCUMENTS 3,735,629 5/1973 Paramonoff .
3,877,761 4/1975 Boden et al. .
3,955,394 5/1976 Kaufman et al. .
4,141,604 2/1979 Habermann et al. .
4,173,138 11/1979 Main et al. .
4,180,296 12/1979 Habermann .
4,353,602 10/1982 Habermann .
4,473,259 9/1984 Goldowsky .
4,504,098 3/1985 Battarel et al. .
4,578,981 4/1986 Nishikawa et al. .
4,583,794 4/1986 Takahara et al. .
4,597,613 7/1986 Sudo .
4,614,104 9/1986 Straw .
4,642,500 2/1987 Higuchi et al. .
4,795,927 1/1989 Morii et al. .
4,807,459 2/1989 Grims et al. .
4,827,163 5/1989 Bhate et al. ..... 310/15
4,827,169 5/1989 Habermann .
4,841,212 6/1989 Matsushita et al. .
4,892,328 1/1990 Kurtzman et al. .
4,912,343 3/1990 Stuart .
4,934,167 6/1990 Grims et al. .
5,212,977 5/1993 Stuart ..... 72/350
5,257,523 11/1993 Hahn et al. ..... 72/349

FIG. 26
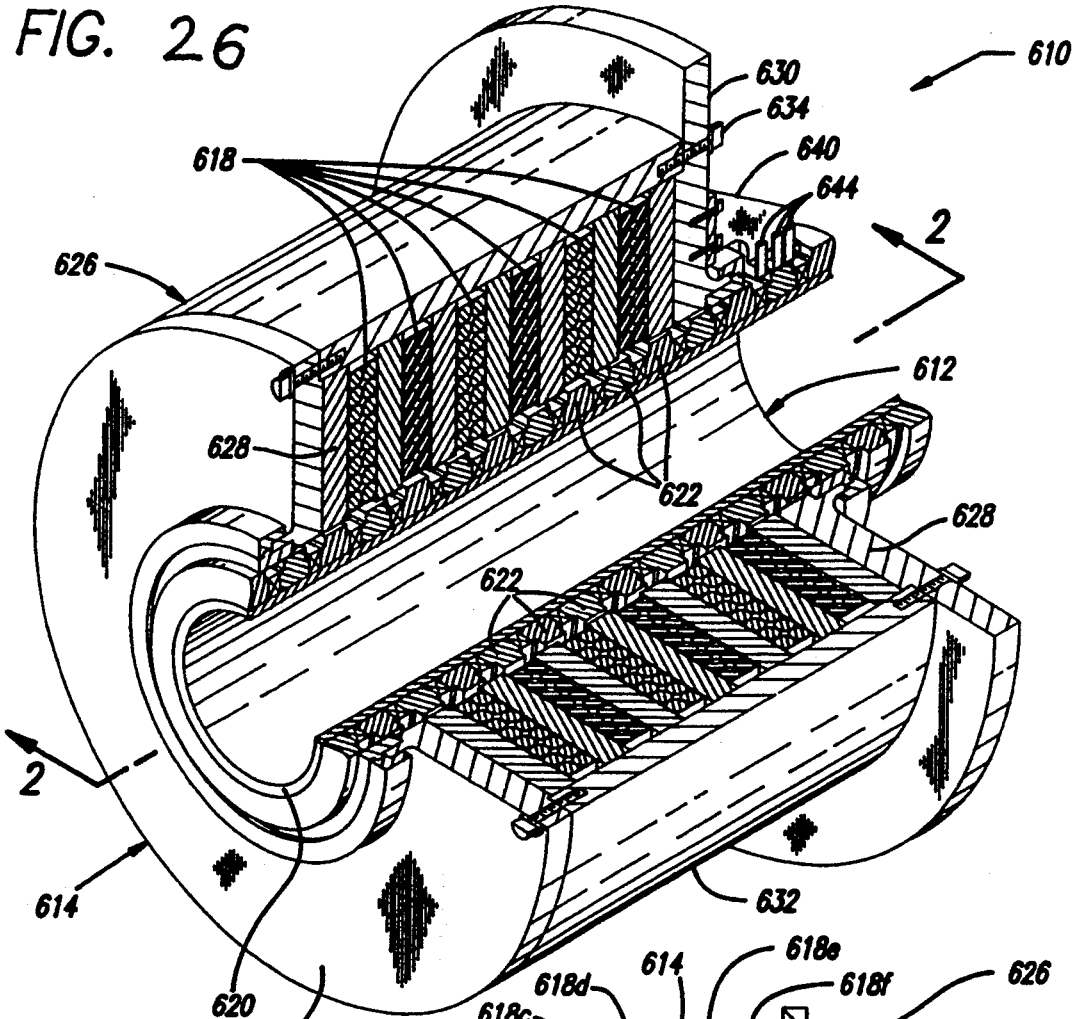
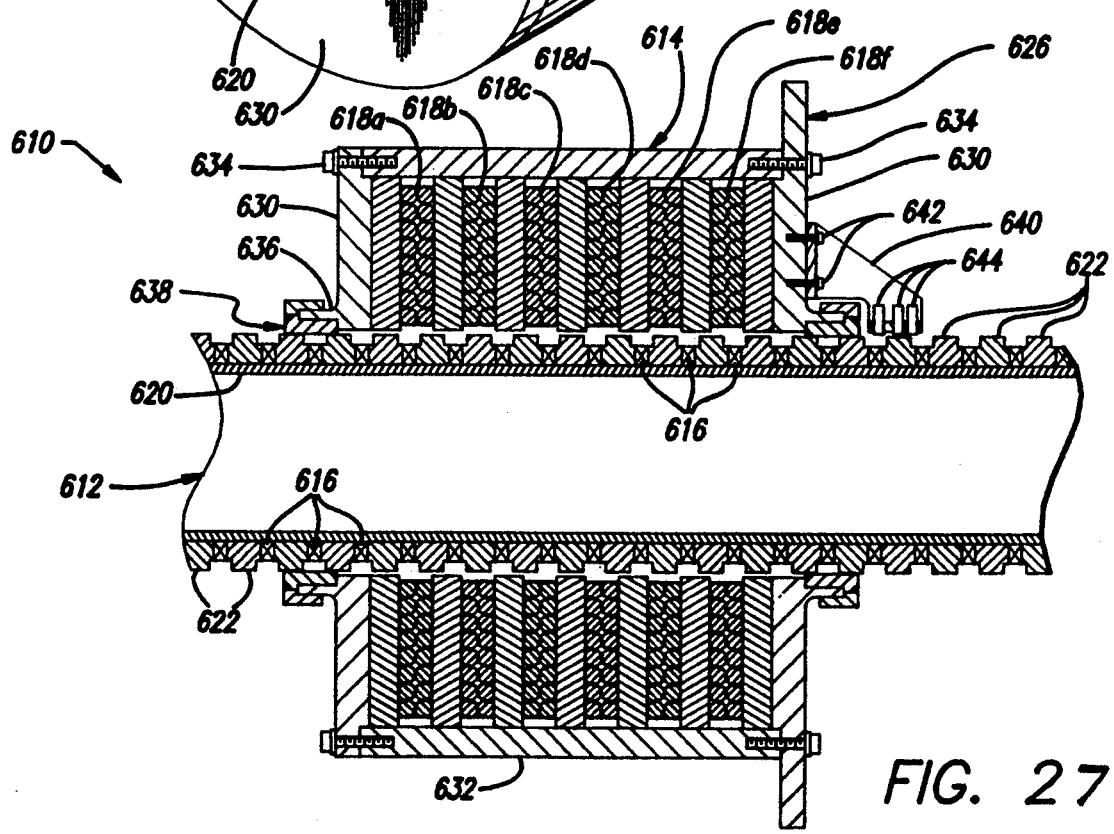
FIG. 27

FIG. 30
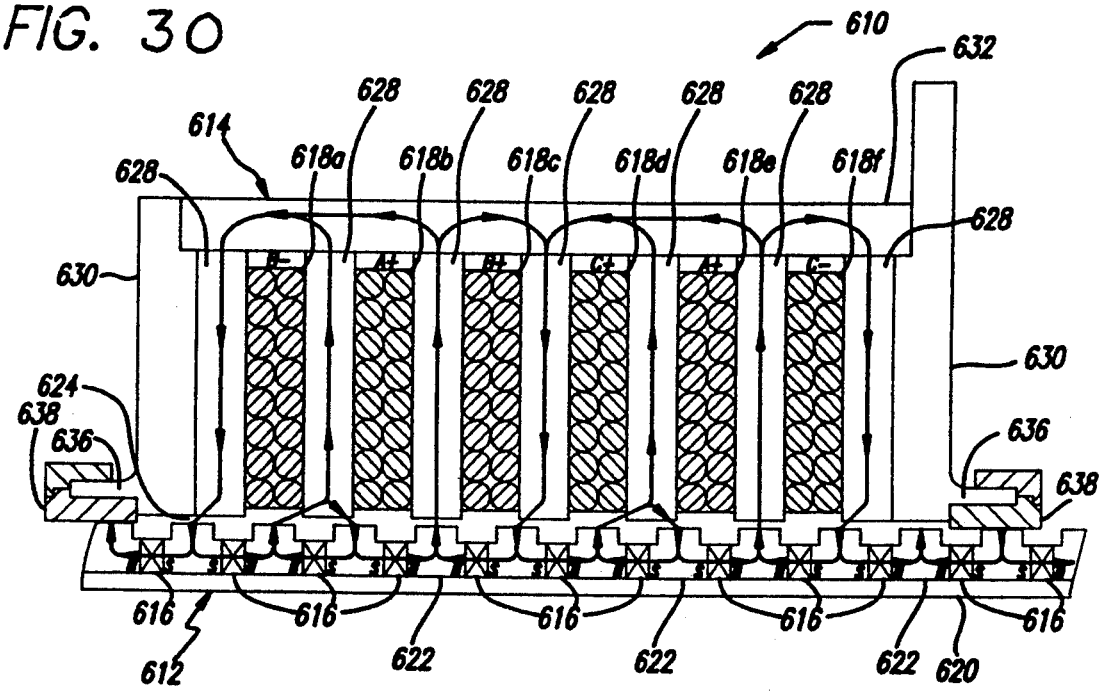
FIG. 31
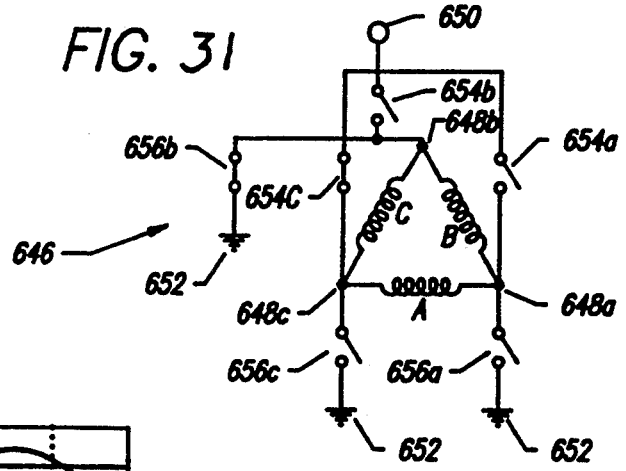
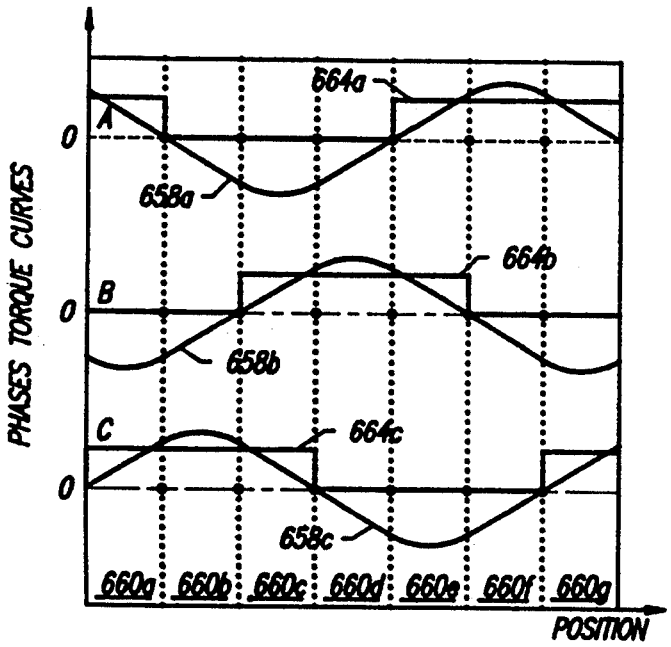
FIG. 32

CAN BODY MAKER WITH MAGNETIC RAM BEARING AND REDRAW ACTUATOR

The present application is a continuation-in-part of U.S. patent application Ser. No. 912,811 filed Jul. 13, 1992 for Can Body Maker With Magnetic Ram Bearing And Redraw Actuator of Roger A. Hahn, Phillip Wayne Gold and Harold Cook, Jr., now U.S. Pat. No. 5,257,523 granted Nov. 2, 1993, which application is a continuation-in-part of U.S. application Ser. No. 724,881 filed Jul. 2, 1991 for CAN BODY MAKER WITH MAGNETIC RAM BEARING AND REDRAW ACTUATOR of Roger A. Hahn, Phillip Wayne Gold and Harold Cook, Jr., now abandoned, which application is a continuation-in-part of copending U.S. patent application Ser. No. 578,938 filed Sep. 7, 1990 for CAN BODY MAKER WITH MAGNETIC RAM BEARING AND REDRAW ACTUATOR of Roger A. Hahn and Phillip Wayne Gold, now abandoned, and of U.S. patent application Ser. No. 871,400 filed Apr. 21, 1992 for Can Body Maker With Magnetic Bearing and Redraw Actuator of Roger A. Hahn, Phillip Wayne Gold and Harold Cook, Jr., now abandoned which application is a continuation of U.S. patent application Ser. No. 578,938 filed Sep. 7, 1990, now abandoned for Can Body Maker with Magnetic Bearing and Redraw Actuator of Roger A. Hahn and Phillip Wayne Gold. which are hereby specifically incorporated by reference for all that is disclosed therein.

FIELD OF THE INVENTION

This invention relates generally to a can body making apparatus and more particularly to a ram assembly and a redraw assembly thereof.

BACKGROUND OF THE INVENTION

A can body making apparatus is described in U.S. Pat. No. 3,696,657 issued to J. H. Maytag, which is hereby incorporated herein by reference for all that it discloses. The ram carriage and redraw carriage are each mounted on rollers which move over carriage way strips. Each pair of upper and lower rollers are urged toward each other so as to be in firm contact with the carriage way strip located therebetween. Both the ram and redraw carriages are reciprocated at rates sufficient to form about two hundred cans a minute. The constant reciprocal movement of the ram and redraw carriages and the tight engagement of the rollers on the carriage way strips result in wear which causes misalignment of the ram or of the can blanks by the redraw sleeve. It is understood that this misalignment is small, between about 0.005 and 0.010 of an inch, but such misalignment can result in defective cans.

U.S. Pat. No. 4,934,167 of Grims et al., which is hereby incorporated by reference for all that it discloses, describes a can body making apparatus having an elongated ram which is connected to apparatus for producing straight line reciprocating motion and which is supported solely by a liquid bearing during the reciprocation thereof.

The Grims et al. patent also discloses a redraw apparatus for a can body making apparatus wherein the redraw carriage is slidably mounted on a pair of spaced apart support posts for reciprocal movement thereover. The support posts are fixedly mounted on a housing holding can forming and ironing dies.

Other U.S. patents which also describe body maker apparatus, which are all hereby specifically incorporated by reference for all that they disclose, are as follows: 4,614,104 of Straw; 4,578,981 of Nishikawa et al.; 4,173,138 of Main et al.; 3,955,394 of Kaufman et al.; and 3,735,629 of Paramonoff.

In certain fields of technology outside the present field of invention it is known to use magnet assemblies to support a moveable shaft. Magnet assemblies for supporting a moveable shaft are described in the following U.S. Patents which are hereby specifically incorporated by reference for all that is disclosed therein: 4,912,343 of Stuart; 4,892,328 of Kurtzman et al.; 4,831,212 of Matsushita et al.; 4,827,169 of Habermann; 4,795,927 of Morii et al.; 4,642,500 of Higuchi et al.; 4,597,613 of Sudo; 4,583,794 of Takahara et al.; 4,504,098 of Battarel et al.; 4,473,259 of Goldowsky; 4,353,602 of Habermann; 4,180,296 of Habermann; 4,141,604 of Habermann et al.; and 3,877,761 of Boden et al.

SUMMARY OF THE INVENTION

The present invention may comprise a can body making apparatus for forming can blanks into elongated can bodies comprising: a stationary support frame; a housing having forming and ironing dies located therein mounted on said support frame; an elongated ram having a first end portion and a second end portion, said first end portion having an outer surface adapted for movement into a redraw assembly to contact a can body preform in said redraw assembly and to move said can body preform out of said redraw assembly and through said forming and ironing dies to form an elongated can body; reciprocating drive means for providing reciprocating axial displacement for said elongated ram; and a redraw assembly located adjacent to said housing, wherein said redraw assembly comprises: a redraw sleeve for supporting a can body preform thereon; redraw carriage means for supporting and axially displacing said redraw sleeve relative said elongated ram; redraw electromagnetic coil means fixedly positioned relative said stationary support frame and having a central coil axis for selectively providing an electromagnetic field; permanent magnet means fixedly mounted with respect to said redraw carriage means in displace relationship with said coil means along said central coil axis for co-acting with said coil means for controllably reciprocatingly displacing said redraw carriage means.

The present invention may also comprise, in a can body maker apparatus of the type having a stationary support frame, a ram assembly which is reciprocatingly displace relative the support frame and a redraw assembly which is reciprocatingly displace relative the support frame, a method of reciprocating the redraw assembly comprising the steps of: mounting a magnetic coil assembly having a central longitudinal axis in fixed relationship with said support frame; mounting a permanent magnet in fixed relationship with said redraw assembly; displacing said permanent magnet along said central longitudinal axis of said coil assembly by selective application of electrical current to said coil assembly.

In normal operation, the redraw sleeve enters the open end of a can body preform and contacts the closed end portion thereof and moves it against the housing and applies a pressure to the closed end portion. In prior art practices, the apparatus for applying the pressure could not be readily adjusted to vary the amount of pressure applied by the redraw sleeve on the closed end portion. This invention provides apparatus for readily adjusting the pressure on the closed end portion and also permits this pressure to be varied as the can body preform is being moved between the redraw sleeve and the housing.

In one preferred embodiment of apparatus for controlling the amount of pressure applied by the redraw sleeve on a portion of the closed end portion of a can body preform, the apparatus described above is used together with stop means for insuring that the redraw carriage does not make contact with the magnetic coil assembly adjacent to the housing.

In another embodiment of the invention, the redraw sleeve is slidably mounted in a bearing which is mounted at a fixed location. A servo motor is connected to the redraw sleeve to reciprocate the redraw sleeve in the bearing. In one embodiment, the servo motor is directly coupled to the redraw sleeve using a gear rack on the redraw sleeve and a gear on the servo motor. In another embodiment, a drive chain is used to rotate a gear in mesh with a gear rack on the redraw sleeve. In one of the above embodiments, an armature is located between the bearing and the housing and in another of the above embodiments, the bearing is between the armature and the housing.

In another embodiment of the invention, releasable clamping means are utilized to connect or disconnect the redraw carriage to the ram to move the redraw carriage to a pressure applying location or to a non-pressure applying location.

In another embodiment of the invention, an electromagnetic linear motor is utilized to move the redraw sleeve to a pressure applying location or to a non-pressure applying location.

BRIEF DESCRIPTION OF THE DRAWINGS

Illustrative and presently preferred embodiments of the invention is shown in the accompanying drawings in which:

FIG. 26 is a fragmented perspective view of an electromagnetic linear motor showing the relative configuration of a generally cylindrical and movable armature within a coaxial stationary stator;

FIG. 27 is a fragmented sectional view taken generally along the line 27—27 of FIG. 6;

FIG. 30 is a schematic fragmented sectional view similar to that illustrated in FIGS. 28 and 29, showing the net magnetic flux generated by the permanent magnets and the electromagnets when the armature is in a third primary position relative to the stator;

FIG. 31 is a schematic representation of a typical three-phase delta connection; and FIG. 32 is a current versus time chart, illustrating the relative polarity and phasing of electric current provided to the three primary electromagnetic coil pairs for generating a magnetic field wave which produces translatory motion of the armature relative to the stator.

DETAILED DESCRIPTION OF THE INVENTION

In General

Figure 1:
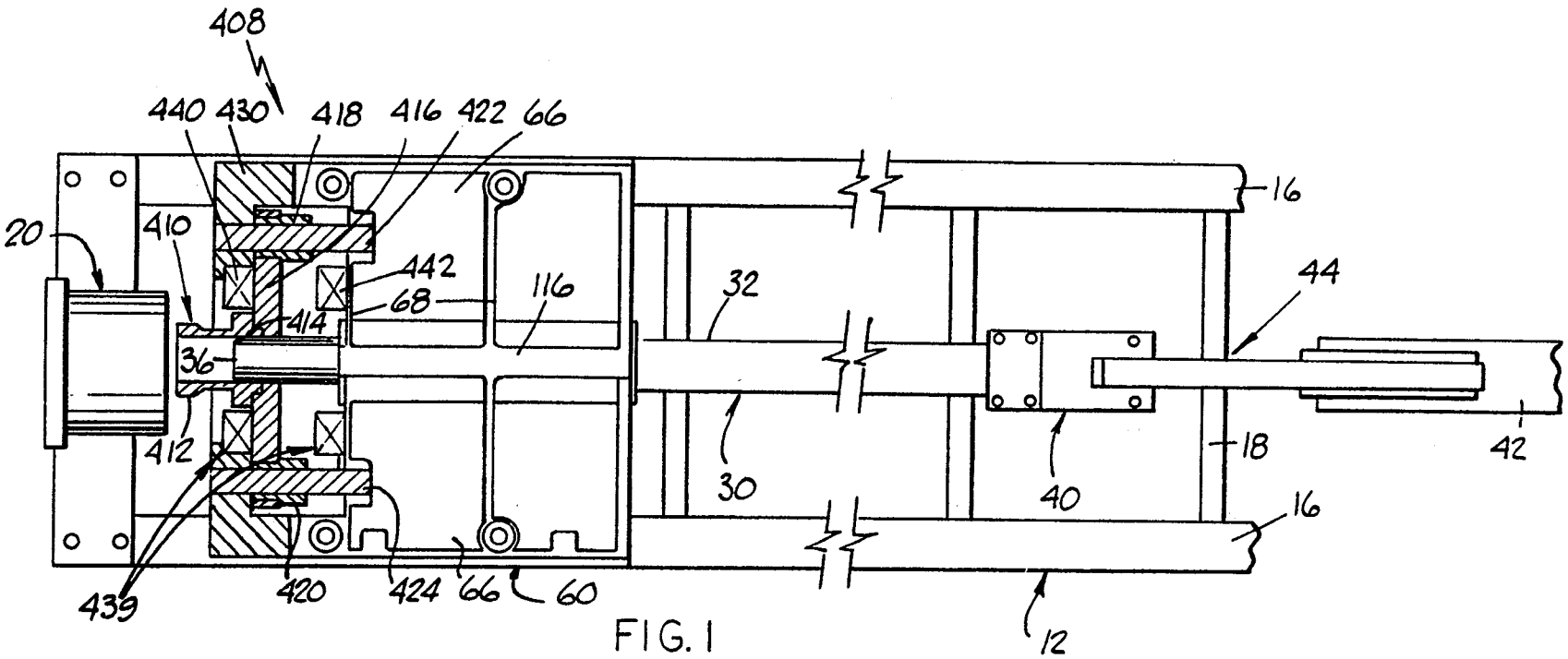
FIG. 1 is a partially cross sectional, top plan view of a can body maker apparatus.

FIG. 1 illustrates a can body maker apparatus 10 of the type having an axially reciprocal ram member 30 and a coaxially aligned redraw assembly 408 which is reciprocally displace independently of the ram member 30. A ram position sensing assembly 50, 148, 150, 248, 250, FIG. 4, senses the position of the ram member and generates a ram position signal in response thereto. An electromagnetic bearing assembly 60 frictionlessly radially supports and aligns the ram member with a predetermined ram displacement path RR. A redraw carriage actuator 439 applies magnetic force to a redraw carriage 416 which produces the reciprocal motion of the redraw assembly. A control unit 130 generates data signals for selectively energizing and de-energizing electromagnets in the electromagnetic bearing assembly 60 and the redraw carriage actuator 439 in response to the ram position signal.

Ram Assembly

As illustrated in FIG. 1, can body maker 10 comprises a support frame 12 comprising a pair of spaced apart linearly extending support beams 16 in parallel relationship and having support legs (not shown) fixedly mounted on a floating support base 14 as is conventional in the art. A plurality of cross-beam members 18 extend between and are connected to the support beams 16 to provide a rigid support structure. A housing 20 having conventional can forming and ironing dies located therein is fixedly mounted on the support beams 16 by suitable means such as nuts and bolts.

An elongated ram 30 is provided and has a main body portion 32 having a generally cylindrical outer peripheral surface 34 and which is constructed from a magnetic material such as steel. The elongated ram 30 has a first end portion 36 for movement into a redraw assembly to contact a can blank (not shown) located therein and to move the can blank through conventional can forming and ironing dies (not shown) in the housing 20 to form an elongated can body (not shown). The elongated ram 30 has a second end portion 38 which is securely mounted in a connecting device 40.

Apparatus 42 extends from machinery, such as the straight line motion assembly described in detail in the above referenced Maytag and Grims et al. patents, which provides the apparatus 42 with a reciprocating linear motion. A connecting arm 44 is connected to the apparatus 42 and the connecting device 40 to transmit the reciprocating linear motion to the connecting device 40 and the elongated ram 30. Apparatus 42 receives motive force from a crankshaft 46, FIG. 4, which is connected by conventional mechanical linkage to an electric drive motor 48. An electronic encoder unit 50 is mounted on the crankshaft 46 and generates a pulse signal which is representative of crankshaft angular position. In one preferred embodiment an encoder is selected which generates 10,000 pulses per crankshaft revolution. The encoder may be either an incremental, absolute, or linear position indicator type as are commercially available in the industry. The encoder pulse signal is provided to a data processing device having a pulse counter which resets at the beginning of each new crankshaft revolution. The ram performs one ram stroke per crankshaft revolution. The encoder pulse count is thus representative of ram axial position.

A magnetic bearing assembly 60 is mounted in a support structure 62 which is mounted on the support beams 16 so as to hold the magnetic bearing assembly 60 at a fixed location. The magnetic bearing assembly 60, described in more detail below, has a generally cylindrical inner surface 64, FIG. 3, having a diameter slightly greater than the diameter of the generally cylindrical outer surface 34 to provide for sliding movement of the ram main body portion 32 through the magnetic bearing assembly. The difference in diameters between the generally cylindrical outer surface 34 and the generally cylindrical inner surface 64 is between about 0.005 and 0.015 inches. The elongated ram 30 during the reciprocation thereof is frictionlessly supported solely by the magnetic force provided by the magnetic bearing assembly 60.

Figure 3:
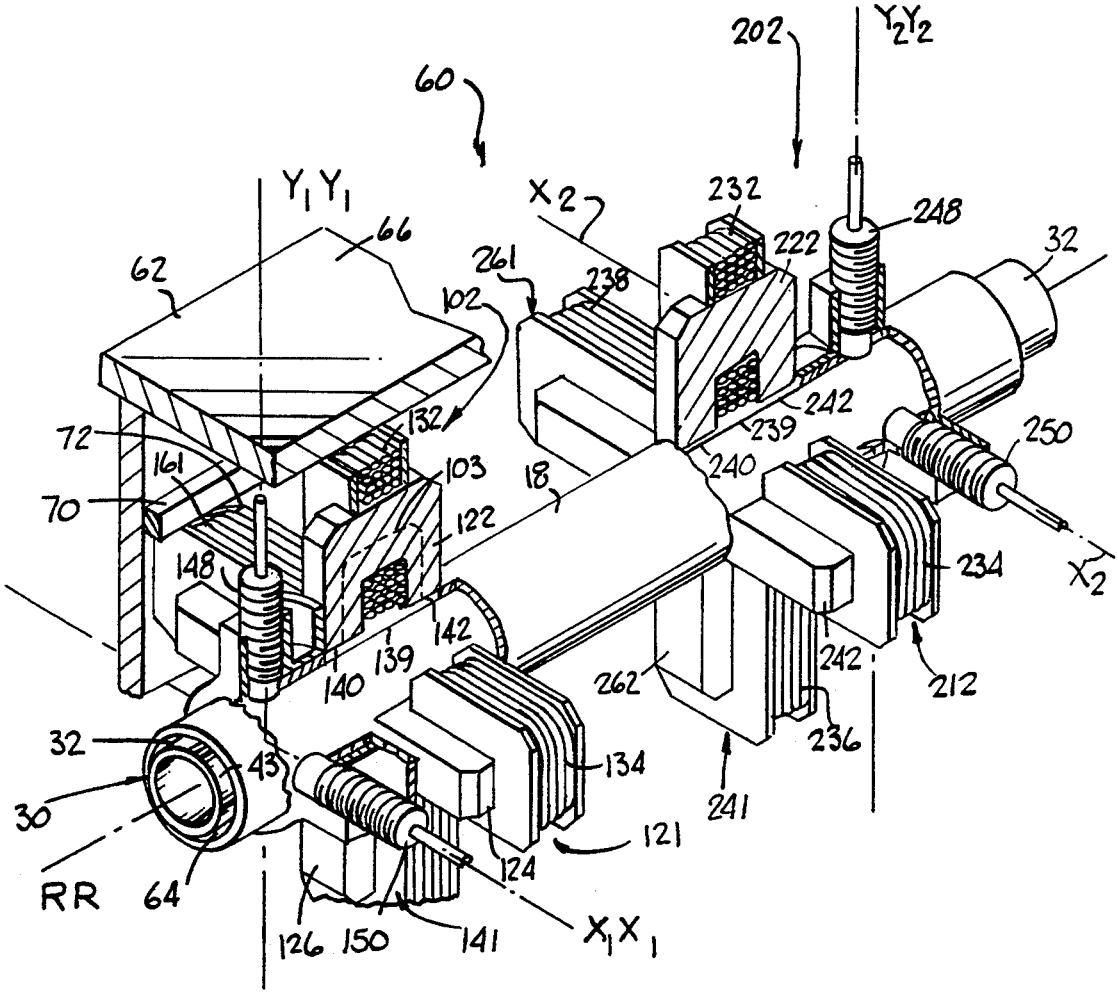
FIG. 3 is a perspective view of a ram magnetic bearing assembly.

The magnetic bearing support housing 62 is illustrated in FIGS. 1 and 3. The support housing 62 comprises an integral casting preferably formed from nonmagnetic material such as cast aluminum and has a pair of linearly extending beams 66 each having a generally planar bottom surface. Beams 66 abut and are attached to beams 16 of support frame 12. A plurality of reinforcing ribs 68 extend between and are integral with beams 66. An interior wall 70 of support housing 62 comprises a plurality of flange portions 72, etc., projecting therefrom which are adapted to be fixedly secured, as by attachment bolts, to various portions of the bearing assembly 60.

Magnetic bearing assembly 60 for frictionlessly supporting ram 30 main body portion 32 is illustrated in FIG. 3. The magnetic bearing assembly includes an elongated cylindrical sleeve 118 which comprises inner surface 64. A forward and a rear magnetic bearing, 102, 202 are provided by two sets of U-shaped stationary electromagnets 110, 112, 114, 116 and 210, 220, 224, 226 and position sensors 148, 150, and 248, 250 respectively are located at each end of sleeve 118 which may be 15 inches long.

Each set of electromagnets preferably consists of four electromagnets, e.g. 110, 112, 114, 116, located 90 degrees apart around the periphery of the sleeve 118 and are operable to generate four orthogonal magnetic fields 130 within the sleeve 118.

Each set of positions sensors, e.g. 148, 150, are aligned with associated electromagnets, e.g. 110, 112, to define two orthogonal horizontal $X_1X_1$, $X_2X_2$ and vertical $Y_1Y_1$, $Y_2Y_2$ axes from which signals proportional to orthogonal ram shaft displacement are provided. These signals are provided to a data processing unit 130, FIG. 4, which also receives the pulse signal from encoder 50.

Figure 4:
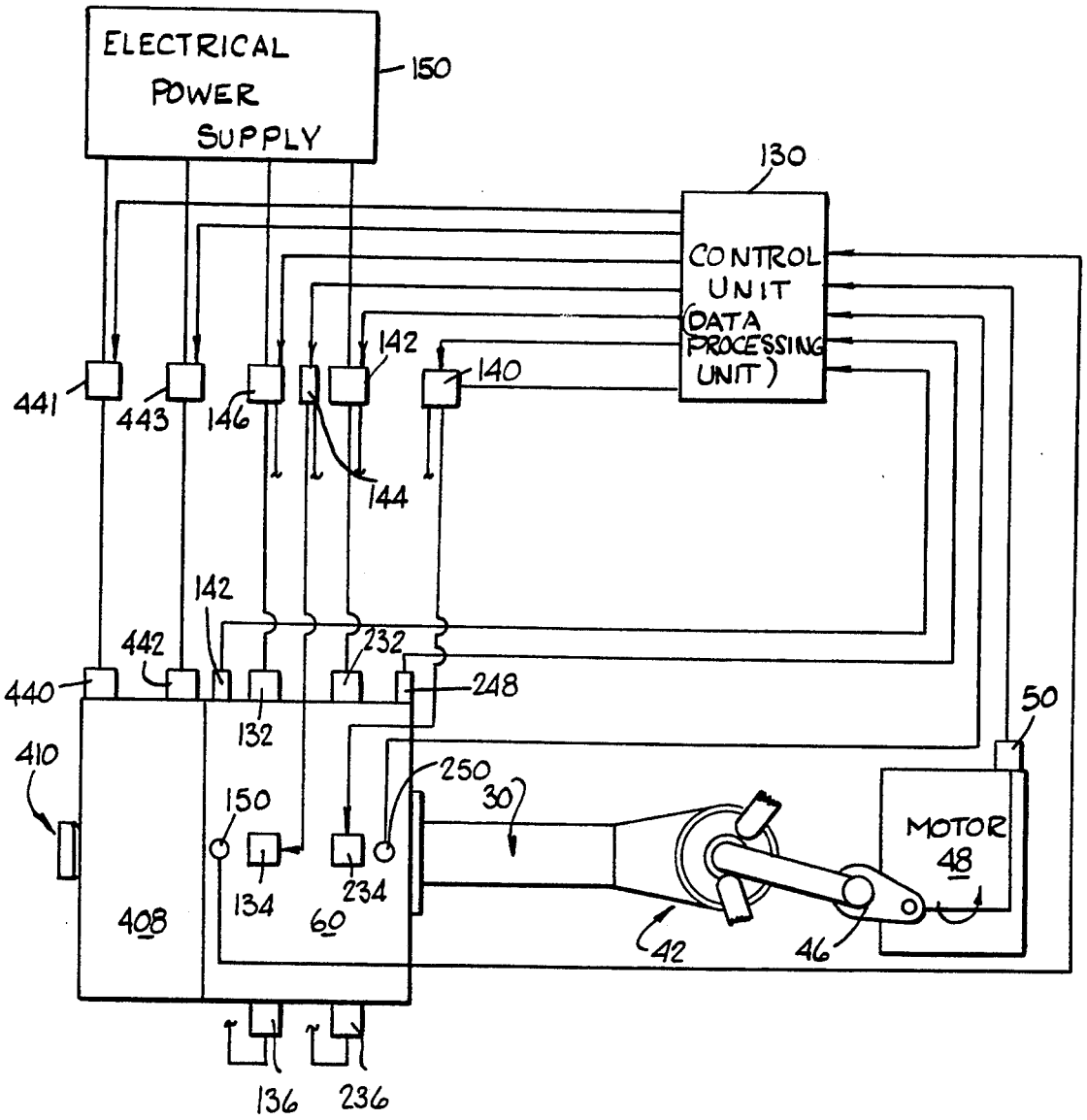
FIG. 4 is a schematic illustration of a control system for the ram and redraw assembly of the body maker apparatus of FIG. 1.

The data processing unit 130 issues control signals to control circuits 142, 144, 144, 146, FIG. 4, which controls the current flow from electric energy source 150 to each opposed set of electromagnets so as to energize the coil windings 132, 134, 136, 138 and 232, 234, 236, 238 for radially centering the elongated ram 30 within the sleeve 118. The electromagnets may be energized either in a linear fashion or in a pulsed manner as is well known in the art. In the preferred embodiment, pulsed energization is employed.

In one embodiment of the invention the data processing unit 130 generates control signals based solely on ram radial position as sensed by sensors 148, 150 248, 250. The data processing unit in this embodiment may comprise hard wired electronic components identical to those described in U.S. Pat. No. 4,473,259 of Goldowsky.

In a preferred embodiment of the invention which is presently the best mode contemplated, data processing unit 130 generates control signals based upon both ram radial position as sensed by sensors 148, 150 248, 250 and is also based upon ram axial position as indicated by encoder 50.

Figure 5:
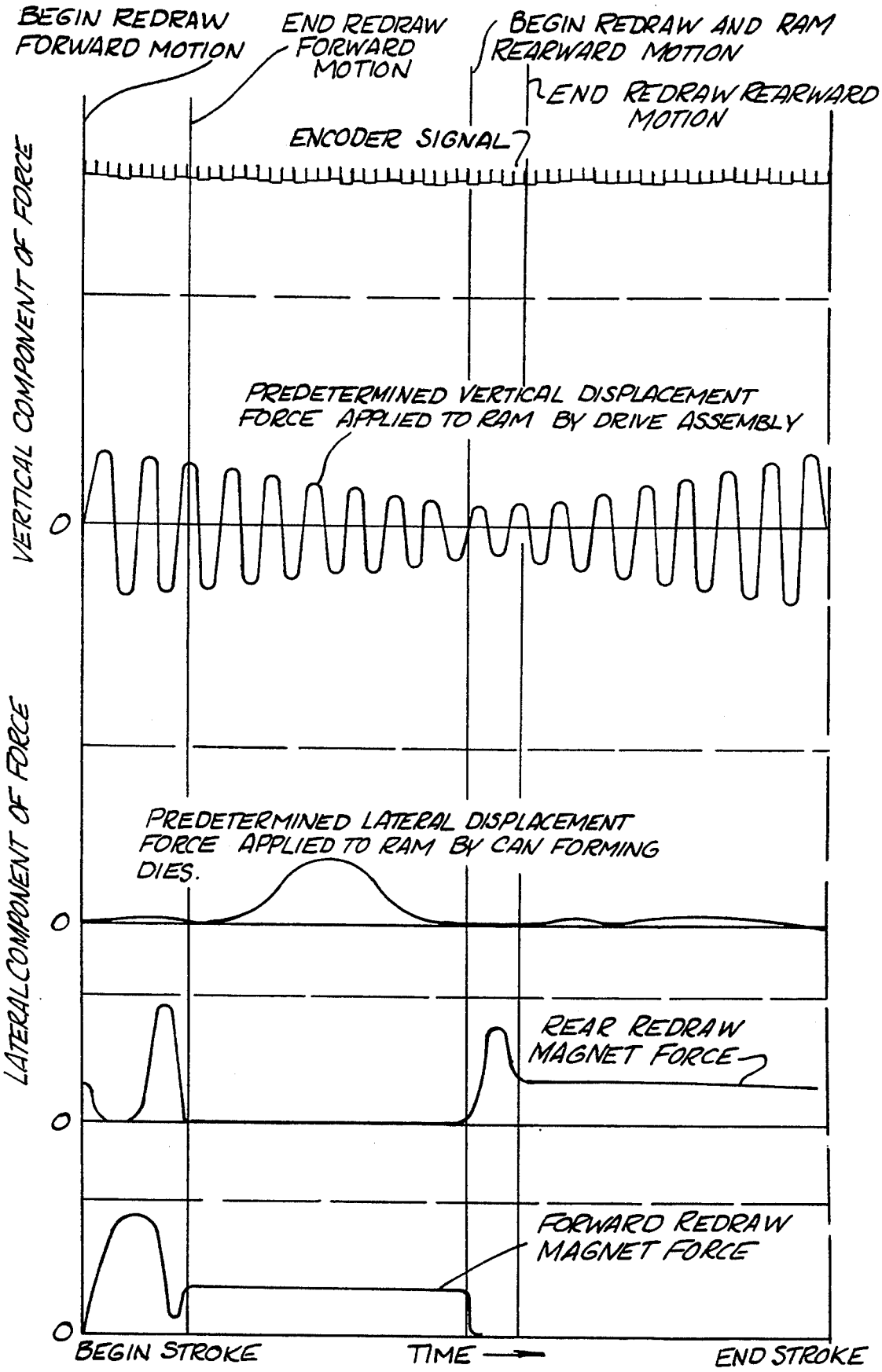
FIG. 5 is a graph illustrating typical vertical and lateral forces exerted on a bearing assembly by a ram.

As indicated in FIG. 5, encoder signal 300 comprises a set of signal pulses 302, 304, etc., which are indicative of the exact axial position of the ram 30 at any point in time. FIG. 5, also shows a force signal 310 which is typical of the total vertical force applied to a magnetic bearing e.g. 202 during a ram operating stroke. Forces which contribute to this total vertical force include a sinusoidal force applied by the ram drive apparatus 42 due to the fact that the linear motion assembly always has a small component of nonlinear force on apparatus 42. This force and also the force attributable to the weight of the ram 30 itself vary in magnitude during the ram stroke due to the changing length of the moment arm associated with each of these forces during a ram stroke. However, these components of the total vertical force exerted on the magnetic bearing are cyclical and under normal operating conditions represent substantially all of the vertical force which will be exerted on the magnetic bearing. This force may be empirically determined using conventional strain gages and/or other means and may be stored as a function of ram axial position in a conventional electronic storage medium such as the RAM of a conventional microcomputer which may comprise a portion of the data processing unit 50.

FIG. 5 further illustrates at 350 the total lateral side loading force which may typically be exerted on electromagnet bearing 202 by ram 30. The short interval large magnitude force indicated at 352 is primarily due to a side force experienced at the end of ram 30 as it moves through the can forming dies. This relatively large magnitude force is cyclical and, like the cyclical vertical force, may also be empirically determined and stored as a function of ram axial position.

There are various forms in which the data represented by curves 310 and 350 may be stored which enables the force value associated with a particular ram position to be readily determined, e.g. in computer look up table form or as a mathematical formula derived by conventional curve matching techniques. As used herein the process of obtaining a force value from this predetermined correlated and stored information representative of ram axial position and associated force will be referred to as "applying a predetermined algorithm" to the ram axial position value regardless of whether the data is stored as a mathematical equation, in a look up table or in any other readily retrievable form.

Since the solid lines 310 350 represent the force applied to a magnetic bearing by the ram during a normal ram stroke it will of course be necessary for the bearing assembly to apply an identical amount of force to the ram 30 at the corresponding axial positions in order to maintain the ram in a centered position in the bearing. Accordingly in one preferred embodiment of the invention the data processing means, which may comprise a conventional microprocessor, at predetermined intervals, e.g. every 5 milliseconds, reads the encoder count and applies a predetermined algorithm thereto based upon the empirically determined force relationship e.g. 310 in order to determine the force to be applied and then provides a control signal to the control circuitry for the associated opposed pairs of magnets e.g. 232, 236, which causes the magnets to apply the determined force to the ram. It will of course be appreciated that in implementing this method of control a separate force/axial position algorithm is determined and stored for use in association with each opposed pair of electromagnets.

In addition to determining a first (primary) force signal based for each opposed pair of electromagnets based upon a stored axial position/force algorithm as described above, the data processing unit 130 may also determine a second (secondary) force signal based upon the radial position of the portions of the ram 30 sensed by sensors 148, 150 and 248, 250. Thus in addition to the primary force signal provided for each opposed magnet pair a secondary signal is also generated for each magnet pair which is added to the primary signal to provide a resultant signal which is used to determine the force applied by the magnet pair. This secondary signal may be generated in a manner identical to that described in the Goldowsky patent. Alternatively, this secondary force signal may be generated through the use of a predetermined algorithm which is stored in computer software and which is applied to the raw sensor signal generated by an associated radial position sensor.

As a further means of control data representative of the each radial position sensor signal value as a function of ram axial position is accumulated and stored for at least one and preferably about 20 previous ram strokes. This stored data is then processed and used to adjust the predetermined algorithm, e.g. 310, which is used to determine the primary force signal which is applied by an opposed magnet pair to the ram 30. Using this further means of control the primary control algorithm may be periodically modified to account for changing conditions, such as heating and cooling of machine components, which may effect the force which must be exerted on the ram to maintain it in a centered position during all phases of the stroke. Using this further means of control it may be possible to determine the primary control algorithm e.g. 310 for each opposed set of electromagnets, e.g. 232, 236, by starting with a straight line primary algorithm and simply running the apparatus. During initial stages of operation most of the control would be provided by the secondary control signal. As the number of operating cycles progress the primary control algorithm, through periodic adjustment would become more and more representative of the actual total control force required and would thus require progressively less adjustment by the secondary control force signal.

Figure 6:
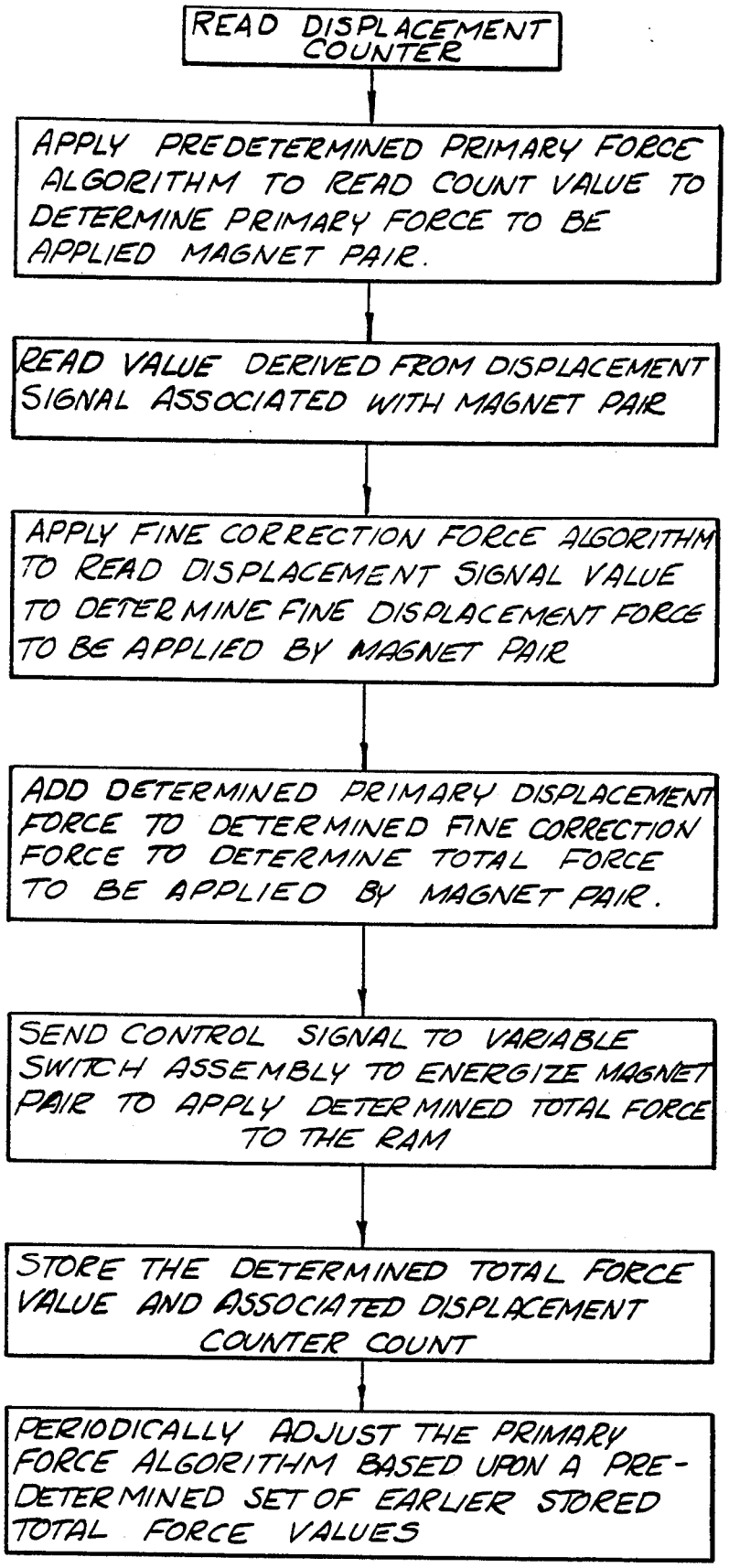
FIG. 6 is a block diagram illustrating the operation of a portion of the control system of FIG. 4.

The above described control method which provides a total control force signal based upon a primary force signal and a modifying secondary force signal and wherein an algorithm used to generate the primary force signal is periodically modified based upon a ram radial displacement signal is illustrated in block diagram form in FIG. 6. It will of course be understood that the method illustrated in FIG. 6 is described for a single pair of opposed electromagnets and that an identical process will be performed for each of the opposed pair of magnets at each sampling interval of the data processing means.

Redraw Assembly

As best illustrated in FIG. 1 redraw assembly 408 comprises a redraw sleeve 410 which is coaxial with ram displacement axis RR. Redraw sleeve 410 has a central cylindrical cavity extending therethrough which is adapted to slidingly receive ram member 30 therethrough. The general sequence of reciprocal motion of redraw sleeve with respect to the motion of ram 30 is as described in the above referenced Maytag patent.

The redraw sleeve 410 comprises a forward end 410 which is adapted to receive a can body preform known as a cup (not shown) thereon. The redraw sleeve comprises a rear end 414 which is fixedly secured to a redraw carriage 416.

The redraw carriage has a first and second bushing 416, 418 mounted therein which are adapted to slide on post members 422, 424. The post members have rear end portions which are fixedly mounted on a forward portion of ram bearing housing 62 and which have forward end portions which are fixedly mounted on redraw support bracket 430 which is itself attached to the ram housing 62.

A redraw actuator assembly 439 is fixedly supported by the support bracket 430. The actuator assembly comprises a forward ring shaped electromagnet 440 positioned forwardly of the redraw carriage and defining the forwardmost travel position of the redraw carriage. The actuator assembly also comprises a rear ring shaped electromagnet 442 positioned rearwardly of the redraw carriage and defining the rearwardmost travel position of the redraw carriage.

Figure 7:
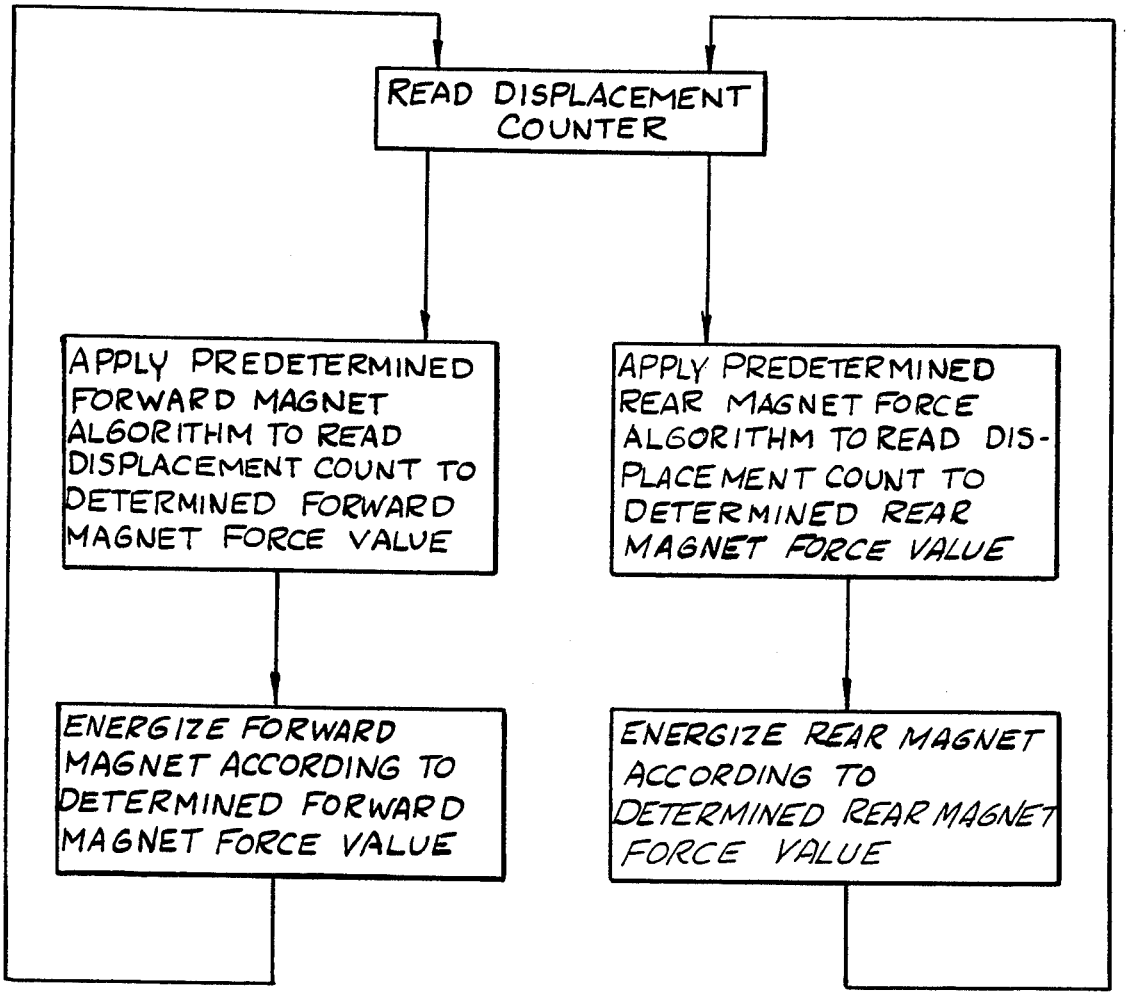
FIG. 7 is a block diagram illustrating the operation of another portion of the control system of FIG. 4.

As illustrated in FIG. 4, the forward and rear redraw magnets 440, 442 are energized and de-energized in response to control signals generated by data processing unit 130. As shown by FIG. 4 and the block diagram of FIG. 7, the data processing means generates control signals which are sent to control circuits 441, 443 to energize or de-energize electromagnets 440, 442. The control signals are generated in response to ram 30 position as determined by the pulse signal from encoder 50. The control signal for each electromagnet 440, 442 is generated by applying a predetermined algorithm to the ram position signal. The algorithm which is applied may be determined analytically or empirically. The resulting force applied by each of the electromagnets causes the redraw carriage to begin moving forwardly at the beginning of each ram stroke. The forward movement of the redraw carriage is sufficiently fast such that the cup carried by the redraw sleeve it moved into engaged position with the tool pack housing 20 prior to the arrival of the ram 30. However the redraw carriage must decelerate sufficiently prior to housing 20 engagement such that there is relatively little rebound at engagement. FIG. 5, illustrates a typical force profile for obtaining such a result. The electromagnets are energized and de-energized in a similar manner to return the redraw carriage to its rearmost position at approximately the same time that the ram 30 begins its rearward travel. If desired, a permanent magnet (not shown) would be mounted in the redraw carriage 416 so that, for example, the north pole thereof faces the electromagnetic coil means 440 and the south pole thereof faces the electromagnetic coil means 442. The electromagnetic coil means 440 and 442 could be selectively energized to produce an attracting force or a repelling force to move the redraw carriage 416 in either direction.

As shown in FIG. 5, a clamping force is applied by the forward redraw magnet 440 to maintain the redraw sleeve in stationary relationship with the abutment surface 19 of the forming die housing 18 after the redraw sleeves forward motion has ended. This redraw clamping force may be a variable force as illustrated in FIG. 5 by the small increase in force which occurs immediately after the point in time where the redraw forward motion ends.

It will be appreciated from the above description that the forward redraw electromagnet 440 may act or as a mean for displacing the redraw carriage and also as a means for applying a clamping force to maintain the can preform carried on the redraw sleeve in abutting contact with abutment surface 19 of housing 20. The electromagnet 440 could also be used exclusively for applying clamping force with the force used to displace the redraw carriage being provided by a conventional mechanical drive assembly such as in the prior art body maker described in U.S. Patent No. 4,934,167, Grims et al.

Alternative Redraw Actuator Assembly

Figure 2:
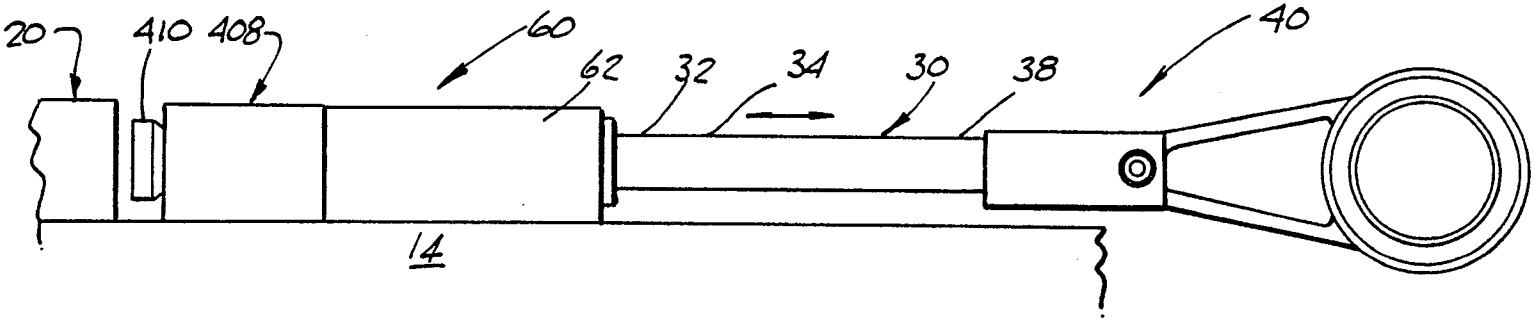
FIG. 2 is a side elevation view of the can body maker apparatus of FIG. 1.
Figure 8:
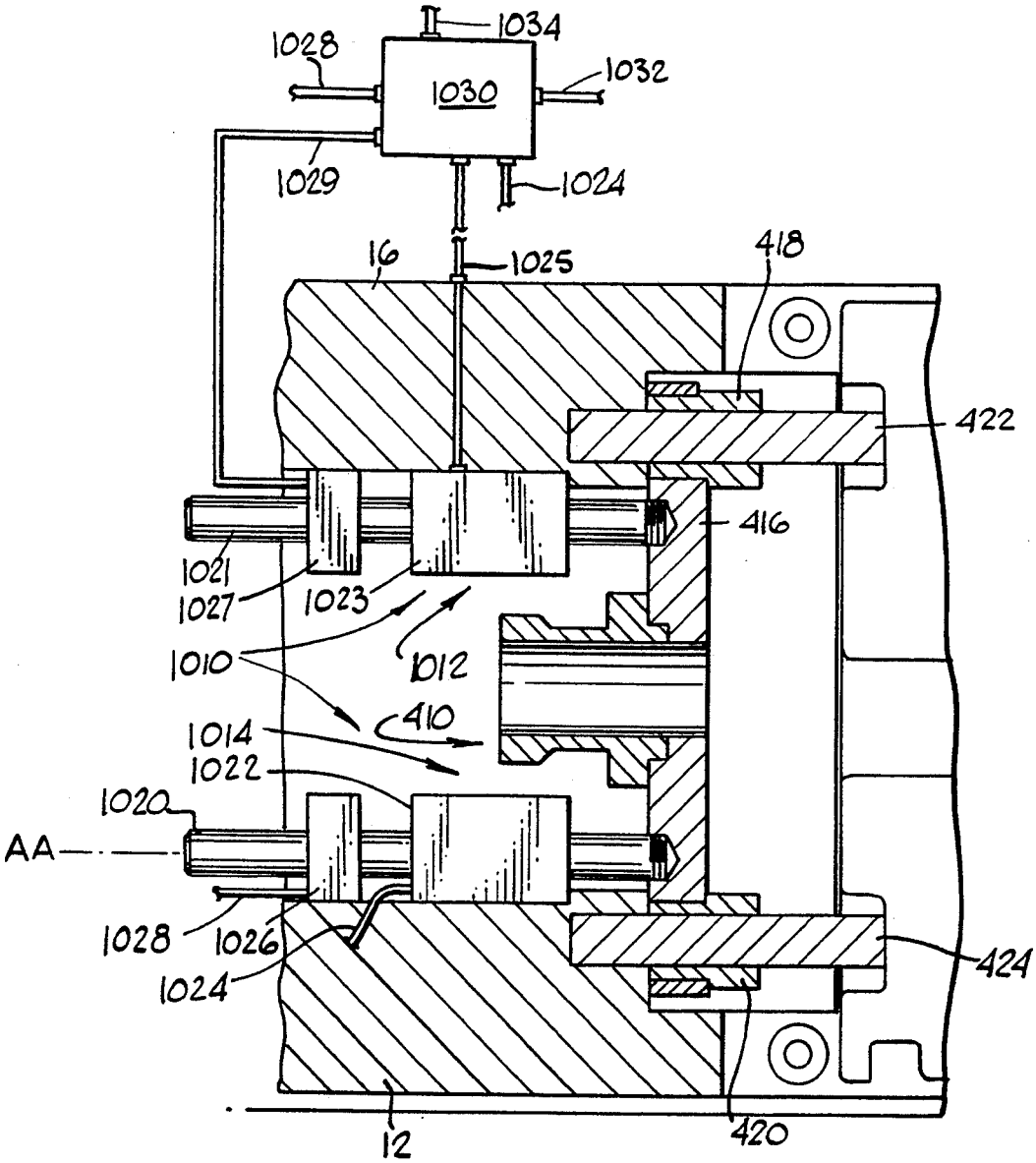
FIG. 8 is a partially cross-sectional top plan view of an alternative embodiment of a can body maker redraw assembly which is provided in a can body maker of the type illustrated in FIGS. 1 and 2.

FIG. 8 illustrates a redraw portion of a can body maker which may be identical to the redraw assembly illustrated in FIGS. 1 and 2, except that an electromagnetic linear actuator 1010 replaces the redraw actuator assembly 439 shown in FIG. 1. The electromagnetic linear actuator 1010 illustrated in FIG. 8 comprises a first and second redraw actuator unit 1012, 1014 associated with opposite lateral sides of the redraw carriage 416. The construction of each of the actuator units 1012, 1014 is preferably identical.

Actuator unit 1014 comprises a shaft 1020 which is fixedly attached to one lateral side of the redraw carriage 416 as by threading attachment, welding, or other conventional attachment means well-known in the art. The shaft 1020 has a central longitudinal axis AA which is parallel to the path of reciprocal movement of redraw sleeve 410. Shaft 1020 passes through an electromagnet assembly 1022 which is energized with electricity provided through electrical cable 1024. The electromagnet assembly 1022 is fixedly mounted on a frame portion 12 of the body maker. Shaft 1020 is longitudinally displace with respect to electromagnet assembly 1022. A shaft position sensor 1026 is also fixedly mounted on body maker frame 12. Shaft 1020 is longitudinally displaceably received therethrough. Position sensor 1026 may comprise a linear voltage differential transformer of a type well-known in the art such as disclosed in Horowitz, P. and Hill, W., *The Art of Electronics*, Cambridge University Press (1980), pp. 602–603; which is hereby specifically incorporated by reference. The shaft position sensor generates a signal indicative of the longitudinal position of shaft 1020 which is transmitted through electrical cable 1028 to redraw controller unit 1030.

Actuator unit 1012 comprises a shaft 1021, electromagnet assembly 1023 with cable 1025, and shaft position sensor 1027 with cable 1029 which may be identical to corresponding components of actuator unit 1014.

Redraw controller unit 1030 receives signals through cables 1028 and 1029 connected to shaft position sensors 1026 and 1027 indicative of the position of redraw actuator shafts 1020 and 1021 and also receives a signal indicative of ram 30 position, e.g. a signal from ram drive encoder unit 50 via cable 1032. The controller receives electrical power through power cable 1034. The redraw actuator shaft and ram shaft position signals are processed by the controller according to one or more predetermined control algorithms which determine the amount and direction of electric current which is supplied to the electromagnetic coils of units 1022, 1023.

Figure 9:
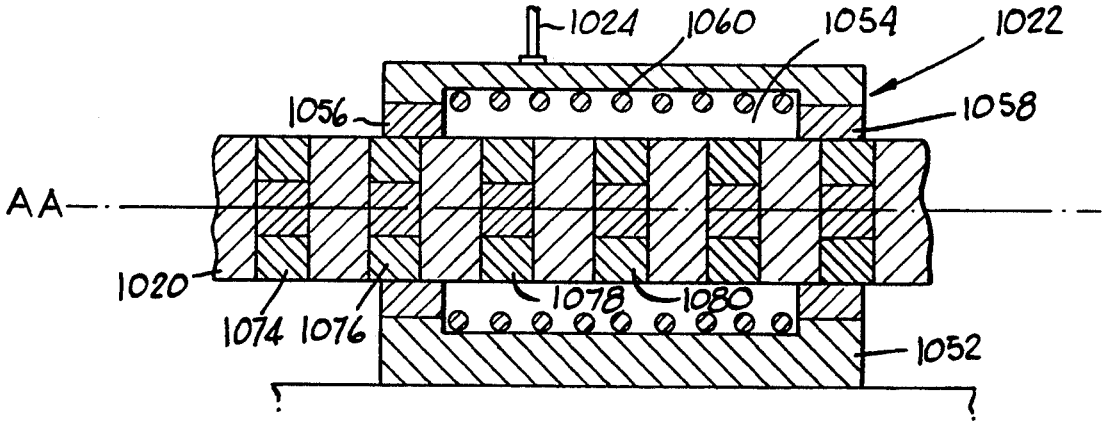
FIG. 9 is a cross-sectional top plan view of a redraw actuator unit of the alternative redraw assembly illustrated in FIG. 8.

As illustrated in FIG. 9, electromagnetic assembly 1022 may comprise a rigid, box-shaped housing 1052 which is fixedly attached to support frame 12. The housing 1052 defines an interior cavity 1054 having openings at front and rear portions thereof in which are mounted ram receiving bearings 1056 and 1058. An electrical coil 1060 helically wound about a central coil axis which is coaxial with shaft 1020 axis AA is provided near the outer periphery of housing interior cavity 1054. The electrical coil 1060 receives electrical energy through cable 1024.

Shaft 30 is constructed from a nonmagnetic material. A plurality of ring magnets 1074, 1076, 1078, 1080 having an outer diameter equal to that of shaft 1020 are fixedly mounted in recessed portions of shaft 1020 in axially spaced relationship as shown in FIG. 9. The magnetic field produced by coil 1060 co-acts with the ring magnets 1074, 1076, etc. to produce an axial force on shaft 1020 which is dependent upon the amount and direction of current through the coil 1060. Coaction between an electromagnetic coil and permanent magnet to produce an axially directed force is described in U.S. Pat. Nos. 4,912,343; 4,892,328; and 4,814,732; each of which is hereby specifically incorporated by reference for all that is disclosed therein.

Figure 10:
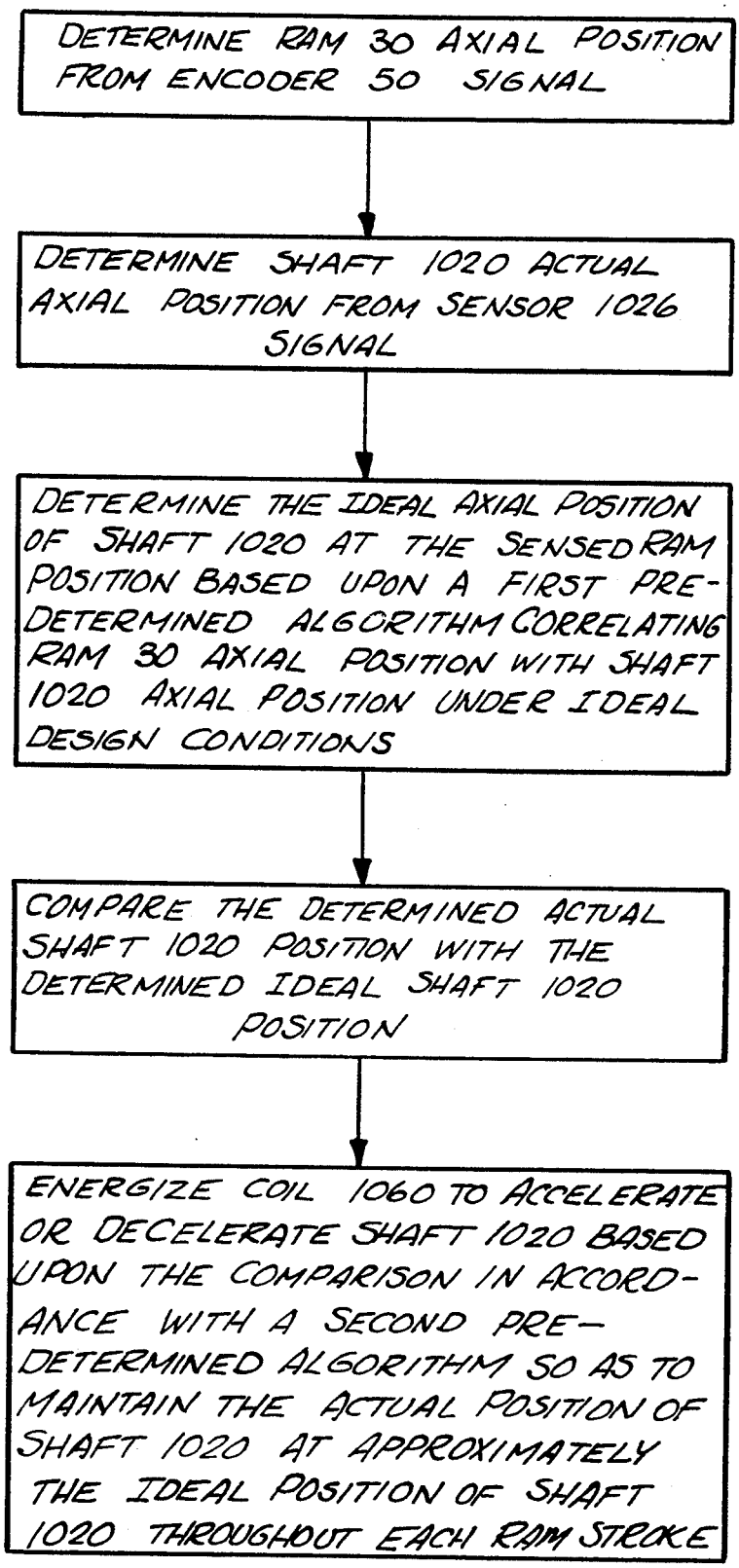
FIG. 10 is a block diagram illustrating one manner by which the position of a redraw carriage shaft is controlled based upon the position of a body maker ram.

The controller 1030 controls the position of redraw carriage shaft 1020 based upon the axial position of ram 30. The manner for controlling shaft 1021 is identical and thus will not be described. The block diagram of FIG. 10 indicates a typical control process which may take place during each sampling interval associated with ram 30 axial movement. Typically, there may be on the order of one sampling interval per millisecond.

Initially, the controller 1030 receives and processes a signal from ram encoder unit 50 to determine the precise axial position of the ram. Next, the controller 1030 receives and processes the signal from sensor 1026 to determine the actual axial position of redraw carriage shaft 1020. Next, the controller 1030 determines the "ideal" axial position of shaft 1020 for the sensed ram axial position based upon a first predetermined algorithm. The first predetermined algorithm correlates ram position and shaft 1020 position during an "ideal" ram stroke in which the position of the redraw carriage at any particular point during the ram stroke is at the exact position intended by the body maker designer. This algorithm may be stored as a mathematical expression or may be stored as a series of correlated data points, etc.

After the ideal axial position of shaft 1020 is determined, this ideal position is compared with the actually sensed position of shaft 1020. Next, based upon this comparison, coil 1060 is energized in the appropriate manner to accelerate or decelerate shaft 1020 to relatively move it in the direction of the ideal ram position. The amount of such acceleration produced on shaft 1020 is a function of the direction and amount of current flowing through coil 1060. The actual amount of current which is supplied is determined based upon a preset control algorithm which utilizes the comparison of shaft 1020 ideal and actual position as an input. The control algorithm may take into account the velocity and acceleration of both ram 30 and shaft 1020, their relative positions in the operating cycle, and/or other variables.

Figure 11:
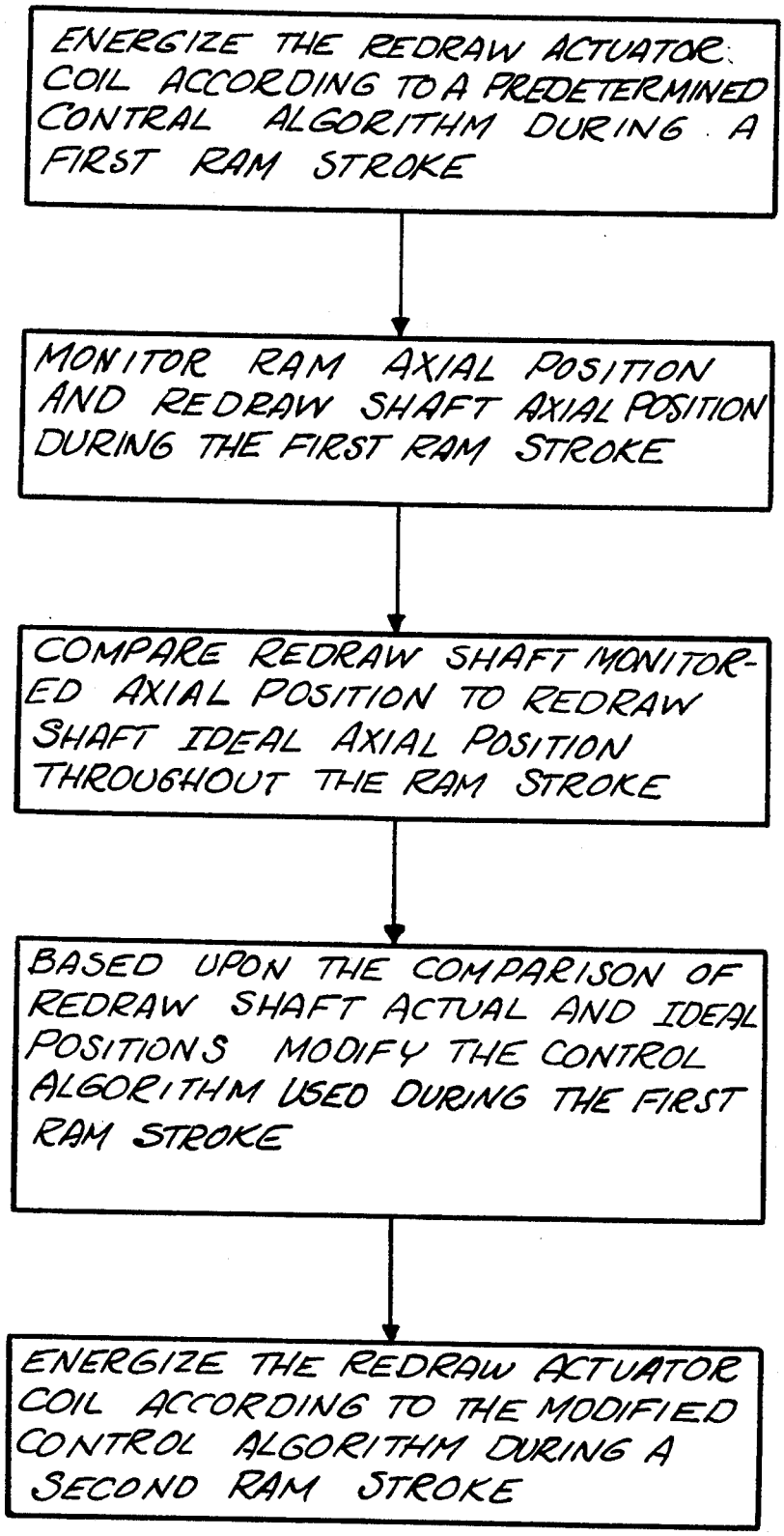
FIG. 11 is a block diagram illustrating an alternative control method to that indicated in FIG. 10.

In an alternative control method as illustrated in FIG. 11, the controller 1030 is provided with a data set indicative of the ideal redraw shaft position associated with each incremental ram position during an ideal operating stroke. Such data set will be referred to herein as the "ideal redraw/ram profile".

During a first actual operating stroke, the redraw actuator coil is energized according to a predetermined control algorithm which is adapted to nominally provide the ideal redraw profile. The actual redraw shaft axial position is monitored as a function of ram axial position during the first ram stroke and is stored as a data set which will be referred to herein as an "actual redraw/ram profile".

Next, this actual redraw/ram profile is compared with the ideal redraw/ram profile by controller 1030.

Next, based upon this comparison of actual and ideal redraw/ram profiles, the control algorithm used during the first ram stroke is modified so as to more accurately energize the redraw actuator coil to produce the ideal redraw/ram profile. This same process again takes place during the second ram stroke, and the control algorithm used in the second stroke is modified at the end of the second stroke and used to control coil energization during the third stroke, etc. In a modified embodiment of this control scheme, the actual redraw shaft displacement as a function of ram movement during several previous ram strokes may be averaged or otherwise collectively used and compared to the ideal redraw/ram profile to provide a basis for modifying the control algorithm. In other words, modification of the control algorithm may take place after several operating strokes, as opposed to after every single operating stroke.

In FIGS. 12–15, there is illustrated another preferred embodiment of the invention which is similar to that illustrated in FIGS. 1 and 2 and reference numerals therefrom will be used on the similar structures. The ring-shaped electromagnetic coil means 440 is fixedly mounted in a bracket 450 secured to the support beams 16. The ring-shaped electromagnetic coil means 442 is mounted on the bearing 60. A redraw carriage 416 is mounted for reciprocal sliding movement over the posts 422 and 424.

Figure 14:
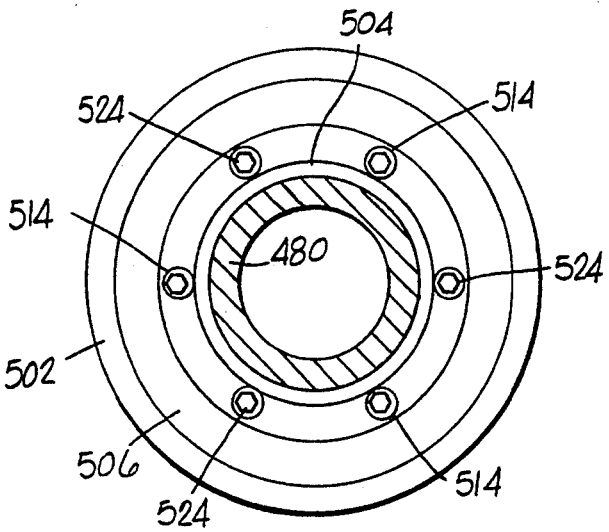
FIG. 14 is a front elevational view of a portion of FIG. 12.
Figure 15:
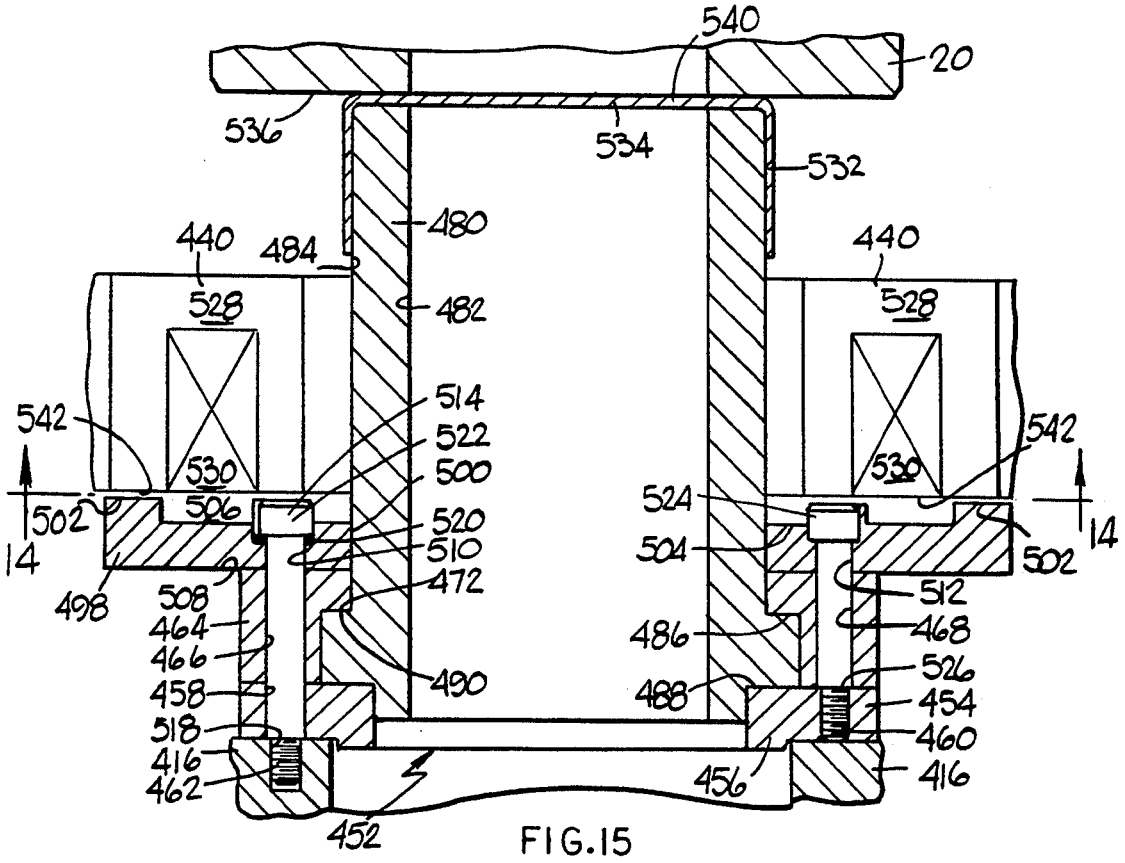
FIG. 15 is an enlarged view of a portion of FIG. 13.

As illustrated particularly in FIGS. 14 and 15, the redraw carriage 14 has a central opening 452 extending therethrough. A support ring 454 is in contact with the portion of the redraw carriage 416 surrounding the central opening 452 and has an annular flange 456 projecting into the opening 452. The support ring 454 has a plurality of smooth bore openings 458 and a plurality of internally threaded openings 460 formed therein. The redraw carriage has a plurality of threaded openings 462 formed therein and located to be in alignment with the smooth bore openings 458.

A spacer ring 464 is seated on the outer portion of the support ring 456 and has a plurality of smooth bore openings 466 formed therein and located to be in alignment with the smooth bore openings 458. The spacer ring 464 also has a plurality of smooth bore openings 468 formed therein and located to be in alignment with the internally threaded openings 460. The spacer ring 464 has a radially inwardly extending flange portion 470 having an abutment surface 472.

A redraw sleeve 480 is provided and has a generally cylindrical inner surface 482 and a generally cylindrical outer surface 484. The redraw sleeve 480 has a radially outwardly extending flange portion 486 which has an abutment surface 488 in contact with the radially inner portion of the support ring 454 and an abutment surface 490 in contact with the abutment surface 472.

An annular armature 498 is provided and has an generally cylindrical inner surface 500 having a diameter slightly greater than the diameter of the generally cylindrical outer surface 484. The annular armature 498 has a generally planar surface 502 which projects in an axial direction from the radially extending surface 504 and has an annular generally U-shaped groove 506 formed therein. The annular armature 498 has a generally radially extending surface 508, a portion of which is in contact with the spacer ring 464. The annular armature 498 has a plurality of smooth bore openings 510 formed therein and located to be in alignment with the smooth bore openings 466 and another plurality of smooth bore openings 512 and located to be in axial alignment with the smooth bore openings 468. A headed shoulder bolt 514 passes through the aligned smooth bore openings 510, 466 and 458 and has a generally cylindrical smooth outer surface 516 having a diameter less than the diameters of the smooth bore opening 510, 466 and 458 to permit axial movement of the support ring 454, the spacer ring 464 and the annular armature 498 relative to the headed threaded shoulder bolts 514. Each of the headed threaded shoulder bolts 514 has a threaded end portion 518 for threaded engagement in the internally threaded openings 462. A resilient ring 520, located between the head portion 522 and the surface of the annular armature surrounding the smooth bore openings 510, limits the axial movement of the support ring 454, the spacer ring 464 and the annular armature 498. A headed threaded shoulder bolt 524 passes through the aligned openings 512 and 468 and a threaded end portion 526 in threaded engagement with the internally threaded openings 460. This arrangement would normally permit limited movement of the annular armature 498 toward the electromagnetic coil means 440. As illustrated in FIG. 15, the electromagnetic coil means 440 comprises an annular U-shaped member 528 having an electric coil 530.

Figure 12:
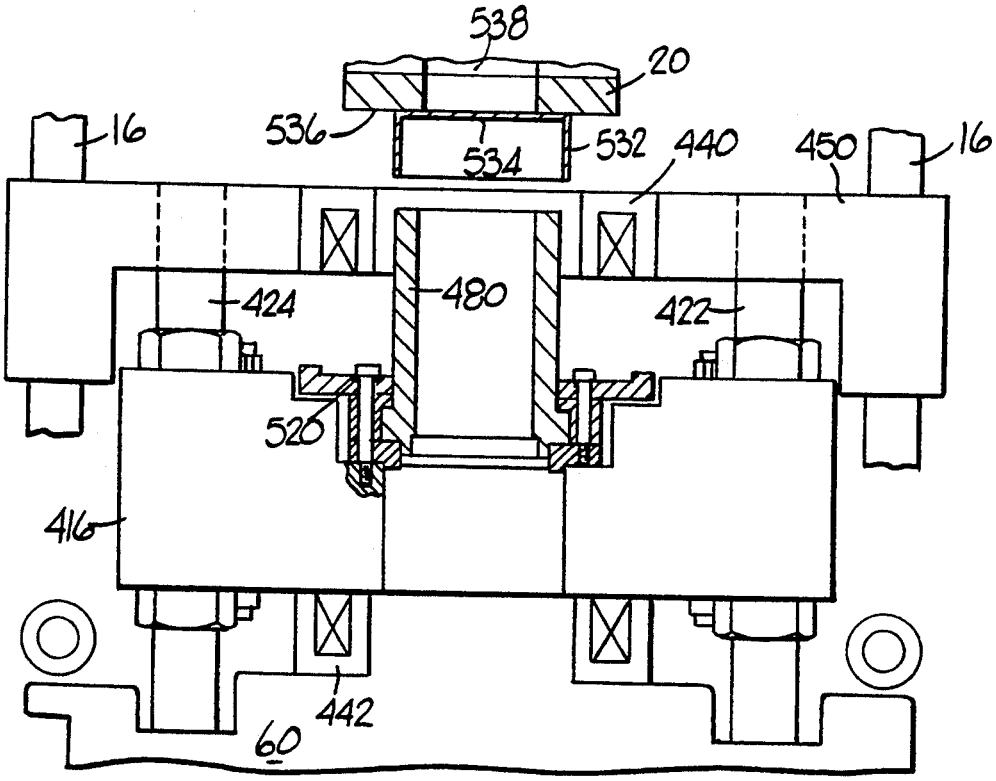
FIG. 12 is a top plan view with parts in section of another preferred embodiment of the invention with the redraw sleeve outside of the can body preform.
Figure 13:
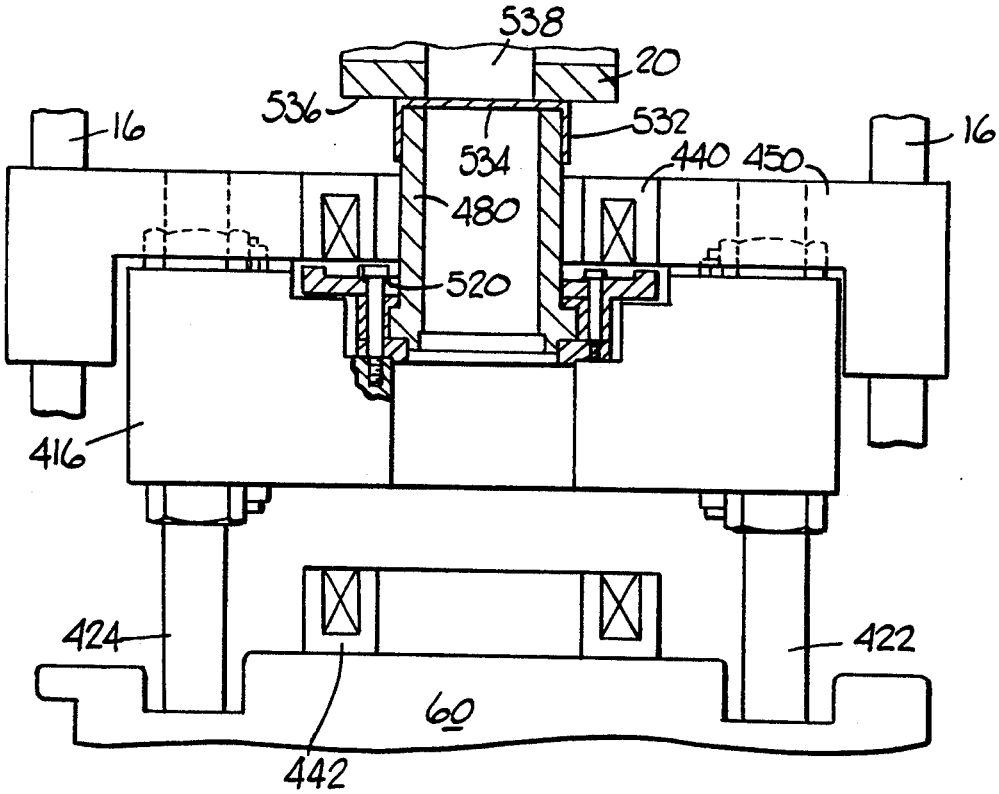
FIG. 13 is a view similar to FIG. 12 with the redraw sleeve being wedged against a portion of the can body preform.

The operation of the apparatus is illustrated in FIGS. 12, 13 and 15. In FIG. 12, the redraw carriage 416 is in it rearward position adjacent to the ram bearing housing 62. A can body preform 532, such as a cup, has been positioned by conventional means (not shown) so that the closed end portion 534 is adjacent to the outer surface 536 of the housing 20 and covers an opening 538 in the housing 20. The ring shaped electromagnets 440 and 442 are operated to move the redraw carriage 416 so that the redraw sleeve 480 moves through the open end of the can body preform 532 until the end surface 540 thereof is in contact with a portion of the closed end portion 534 to force the portion of the closed end portion 534 against the outer surface 536. The planar surface 502 is spaced from the end surfaces 542 of the annular U-shaped member 528 a distance of between about 0.005 and 0.015 inch. As described below, the O-ring 520 functions to ensure the proper spacing between the planar surface 502 and the end surfaces 524. The data processing unit is programmed so that, when the redraw sleeve 480 is in the location illustrated in FIG. 15, an additional current is then passed through the ring-shaped electric coil 530 to produce a magnetic force tending to attract the annular armature 498 toward the annular U-shaped member 528 which movement is prevented by the contact between the redraw sleeve 480, the closed end portion 534 and the outer surface 536. The magnetic force on the annular armature 498 is transmitted to the redraw sleeve 480 so that the redraw sleeve 480 applies a pressure against the portion of the closed end portion 534. This structure allows the pressure exerted by the redraw sleeve 480 on the closed end portion 534 to be controlled to be between about 800 pounds and 4,000 pounds as the first end portion 36 of the elongated ram 30 moves the can body preform 532 through the housing 20. If the redraw sleeve 480 does not contact the portion of the closed end portion 534, the O-ring 520 is mounted in a space to provide for slight deformation of the O-ring 520 to permit slight movement of the redraw sleeve relative to the redraw carriage 416 to permit it to move into contact with the portion of the closed end portion 534 and apply pressure thereto. The amount of relative movement between the redraw sleeve 480 and the redraw carriage 416 is determined by the relative sizes of the O-ring 520 and the space in which it is located. If the redraw sleeve 480 is in contact with the closed end portion 534 and the closed end portion 534 is in contact with the outer surface 536, the armature 498 will move relative to the redraw sleeve 480 until the O-ring 520 fills the space so that the magnetic force on the annular armature 498 is transmitted to the redraw sleeve 480 to apply the pressure against the portion of the closed end portion. The pressure on the closed end portion 534 may be maintained constant or can be varied as the can body preform 532 is being moved through the housing 20. After the can body preform 532 has been drawn into the housing 20, the ring-shaped electromagnet, i.e. coil means 440 and 442, is operated, as described above, to move the redraw carriage 416 to its rear location adjacent to the ram bearing housing 62.

The annular armature 498 and the annular U-shaped member 528 are preferably formed from a highly magnetizable material, such as silicon steel, while the other structures are formed from conventional materials, such as aluminum or 300 series stainless steel (non-magnetic).

If desired, the redraw carriage 416 could be moved by other apparatus such as that illustrated in the Maytag, Grims et al and Paramonoff patents.

The apparatus illustrated in FIG. 1 can be designed to permit the varying of the pressure on the closed end portion 534. This can be accomplished by providing the redraw sleeve 412 with a sufficient axial extent so that when the redraw sleeve 412 is in contact with the closed end portion 534, the redraw carriage 416 is spaced from the ring-shaped electromagnetic coil means 440. Therefore, varying the current in the ring-shaped electromagnetic coil means 440 will vary the pressure of the redraw sleeve 412 on the closed end portion 534. Also, the redraw sleeve 412 could be mounted on the redraw carriage 416 as illustrated in FIGS. 12, 13 and 15 to control the pressure exerted by the redraw sleeve 412 on the closed end portion 534.

The apparatus illustrated in FIGS. 8 and 9 also can be designed to operate so that the pressure on the closed end portion 534 can be varied. The control algorithm will first move the redraw sleeve into contact with the closed end portion 534 and then the current in the coil 1060 is varied in response to a signal from the data processing unit 130 to vary the pressure on the closed end portion 534.

Figure 18:
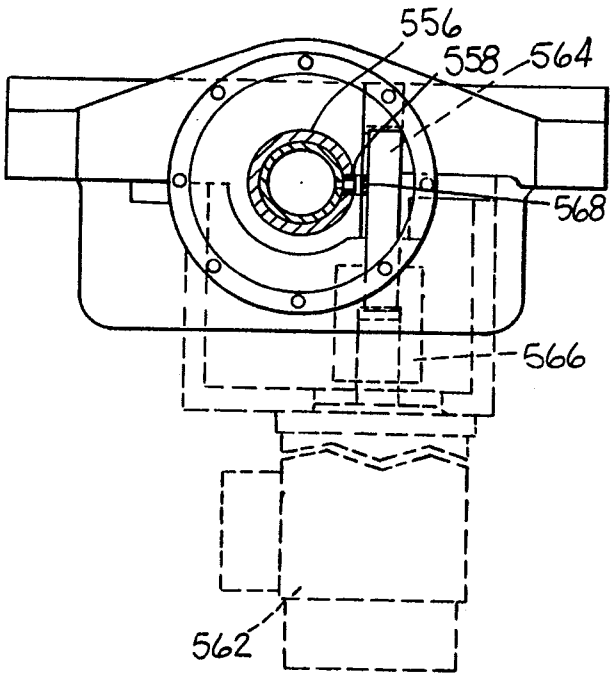
FIG. 18 is a rotated elevational view with parts in section taken from the right side of FIG. 16.
Figure 16:
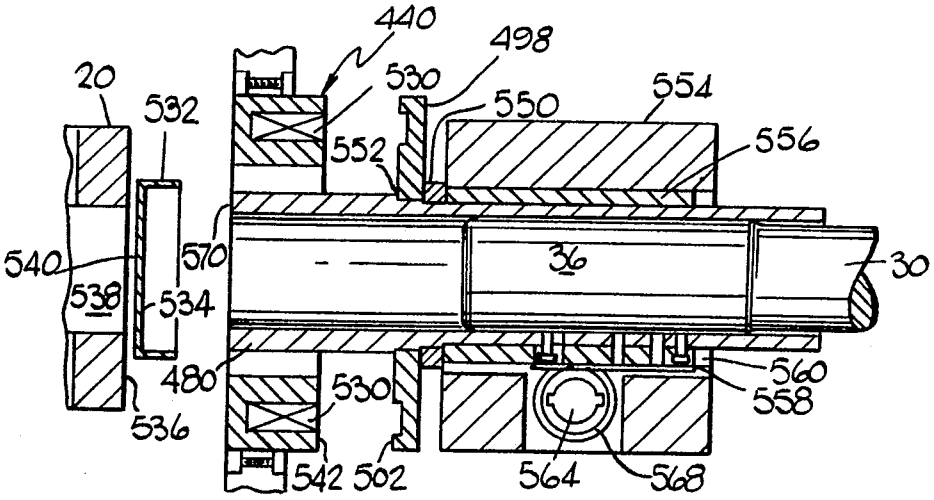
FIG. 16 is a top plan view with parts in section of a further preferred embodiment of the invention with the redraw sleeve outside of the can body preform.
Figure 17:
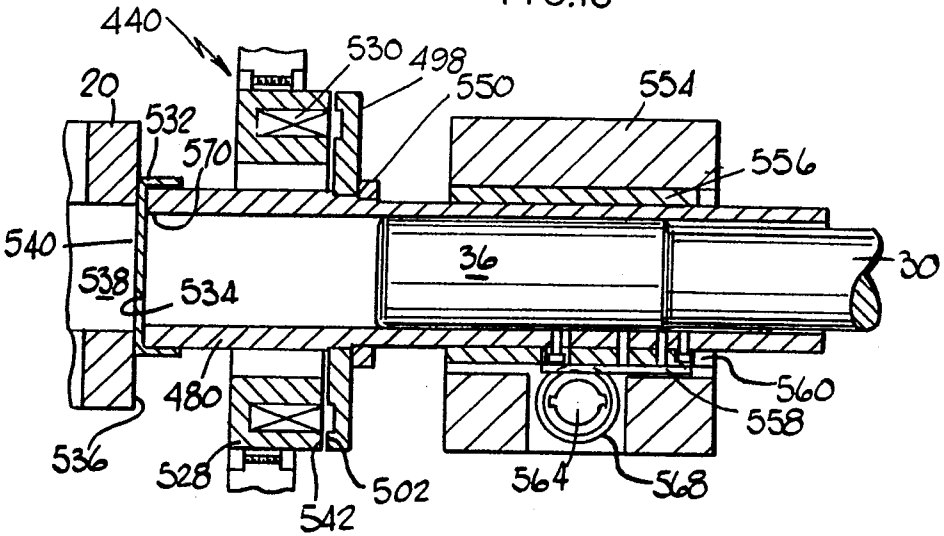
FIG. 17 is a view similar to claim 17 with the redraw sleeve being urged against a portion of the can body preform.

Another embodiment of the invention is illustrated in FIGS. 16–18 wherein similar parts have been identified with the reference numerals used in FIGS. 12–15. The armature 498 is mounted on the redraw sleeve 480 using a threaded nut 550 to force a portion of the armature 498 against an abutment 552 on the redraw sleeve 480. A bearing support 554 is fixedly mounted on the support frame 12 and has a bearing 556 mounted therein at a fixed location. The bearing 556 can be a bronze bearing, a fluid bearing, an oil lubricated bearing or any other type of bearing. A portion of the redraw sleeve 480 is slidably mounted in the bearing 556.

A gear rack 558 is fixedly mounted on a portion of the redraw sleeve 480 and projects outwardly through a slot 560 in the bearing 556. A servo motor 562 is fixedly mounted on the support frame 12 and is connected to a shaft 564 by a coupling 566 so that the shaft 564 is rotated by the servo motor 562. A gear 568 is mounted on the shaft 564 for rotation therewith and is in mesh with the gear rack 558 so that rotation of the gear 568 moves the gear rack 558 and therefore, the redraw sleeve in reciprocating linear directions.

In FIG. 16, the redraw sleeve 480 is in the non-pressure applying location. In FIG. 17, the servo motor, in response to a go signal from the data processing unit 130, has moved the redraw sleeve 480 into the pressure applying location. The end 570 of the redraw sleeve 480 has moved into contact with the closed end portion 534 and has moved a portion of the end surface 540 against the outer surface 536 of the housing 20. The end surface 542 of the annular U-shaped member 528 is spaced from the planar end surface 502. In response to a signal from the data processing unit 130, a current is passed through the electric coil 530 to attract the annular armature 498 toward the annular U-shaped member 528 but the movement of the annular armature is prevented by the contact of the end 570 of the redraw sleeve against the portion of the closed end portion 534 and the outer surface 536 of the housing 20. This magnetic attracting force results in a pressure applied by the end 570 on the closed end portion 534. As stated above, the current passed through the electric coil 530 allows the pressure on the closed end portion 534 to be controlled between about 800 pounds and 4,000 pounds as the first end portion 36 moves the can body preform 532 through the housing 20.

Figure 21:
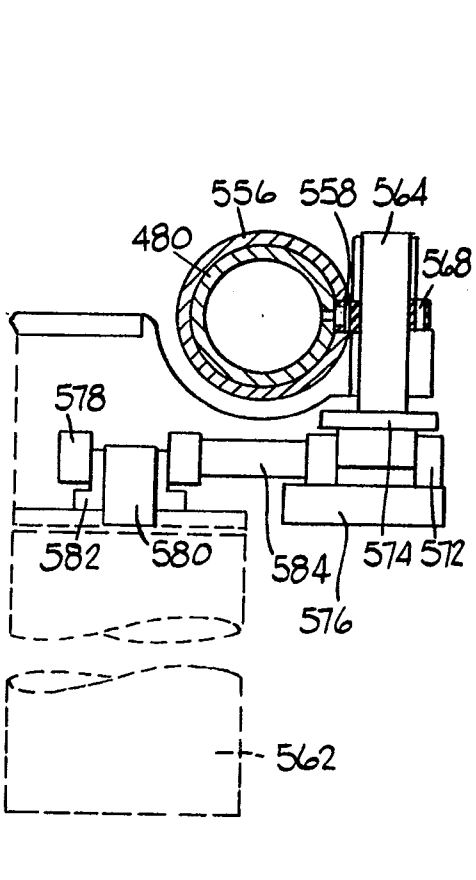
FIG. 21 is a rotated elevational view with parts in section taken from the right side of FIG. 19.
Figure 20:
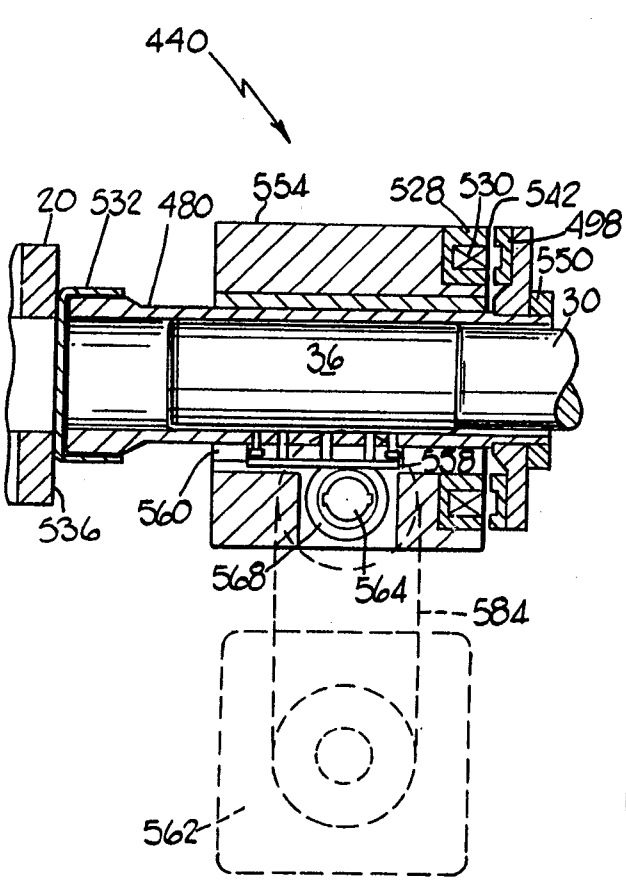
FIG. 20 is a view similar to FIG. 19 with the redraw sleeve being urged against a portion of the can body preform.
Figure 19:
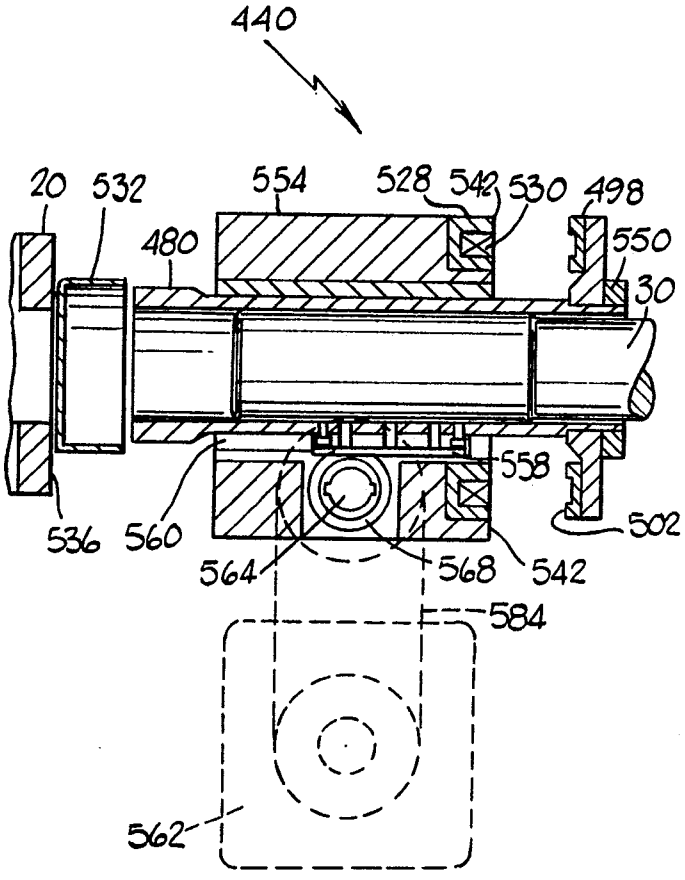
FIG. 19 is a top plan view with parts in section of a further preferred embodiment of the invention with the redraw sleeve outside of the can body preform.

The embodiment of the invention illustrated in FIGS. 19–21 is similar to that illustrated in FIGS. 16–18 and similar parts have been identified with the same reference numerals. The electromagnetic coil means 440 is mounted in the bearing support 554. The shaft 564 has a sprocket 572 mounted thereon by a coupling member 574 and is rotatably mounted in a bearing 576. The servo motor 562 has a sprocket 578 mounted on its shaft 580 by a coupling member 582. A drive belt 584 is journalled around the sprockets 572 and 578 so that rotation of the shaft 580 rotates the shaft 564. The apparatus in FIGS. 19–21 operates in a manner similar to that in FIGS. 16–18.

Figure 22:
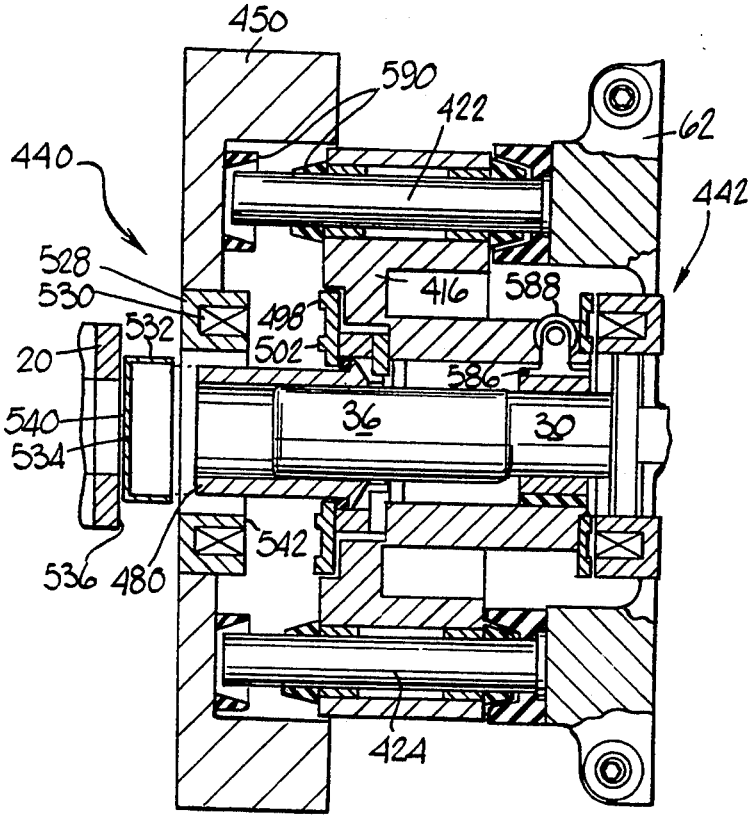
FIG. 22 is a top plan view with parts in section of a further preferred embodiment of the invention with the redraw sleeve outside of the can body preform.
Figure 23:
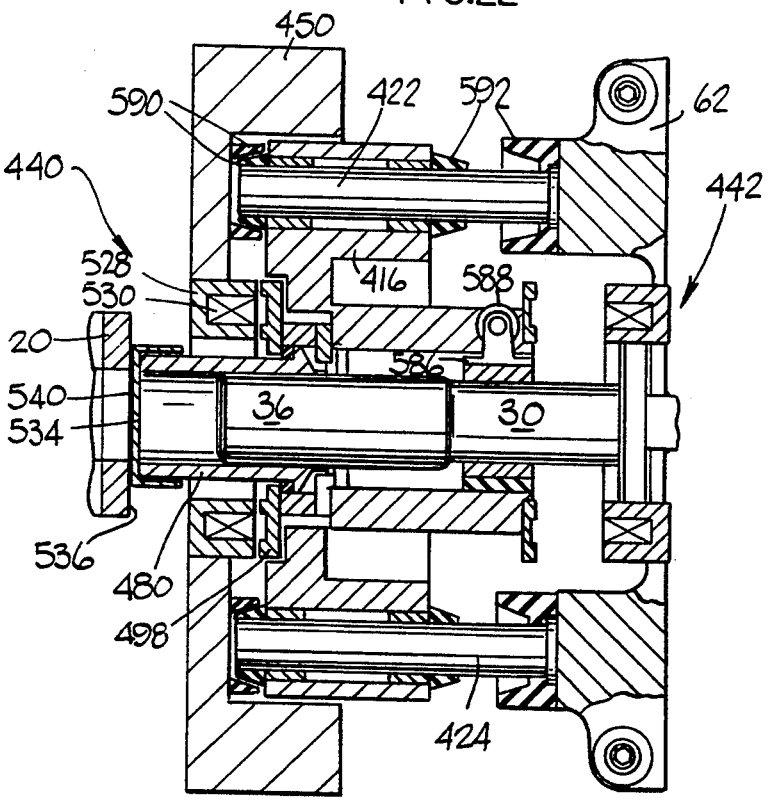
FIG. 23 is a view similar to FIG. 22 with the redraw sleeve being urged against a portion of the can body preform.

Another embodiment of the invention is illustrated in FIGS. 22 and 23 where parts similar to FIGS. 12–15 have been identified with the same reference numerals. Releasable clamping means 586 are mounted on the redraw carriage 416 for movement therewith. The releasable clamping means 586 are moved between clamping and non-clamping positions by a solenoid 588. Shock absorbing means 590 are provided for limiting the movement of the redraw carriage 416 toward the housing 20. Shock absorbing means 592 are provided for limiting the movement of the redraw carriage away from the housing 20.

When the redraw carriage 416 is in the position illustrated in FIG. 22, the solenoid 588 is actuated to move the releasable clamping means 586 to the clamping position on the ram 30 so that the redraw carriage 416 will move with the ram 30. When the redraw carriage 416 is in the position illustrated in FIG. 23, the solenoid 588 has been actuated to move the releasable clamping means 586 to the non-clamping position. The end of the redraw sleeve 480 has contacted a portion of the closed end portion 534 and moved it against the outer surface 536 of the housing 20. The electric coil 530 is then energized, in response to a signal from the data processing unit 130, to produce a magnetic force on the annular armature 498 which, as described above, applies a force on the redraw sleeve 480 to apply a pressure on the portion of the closed end portion 534. As described above, the pressure can remain the same or can be varied as the can body preform 532 is moved through the housing 20.

Figure 24:
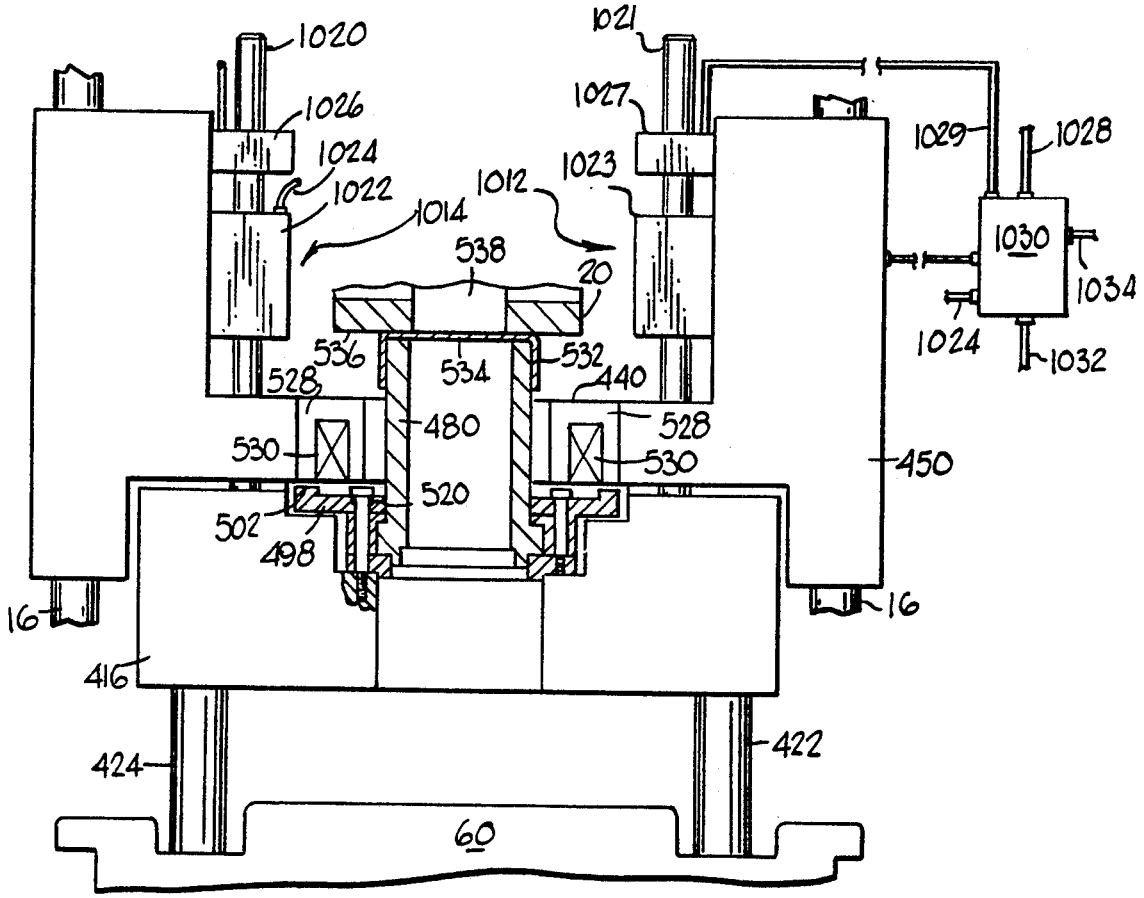
FIG. 24 is a top plan view with parts in section of a further embodiment of the invention with the redraw sleeve being urged against the can body preform.

Another preferred embodiment of the invention is illustrated in FIG. 24 which is a composite of portions of FIG. 8 and FIG. 13. The control algorithm will move the redraw sleeve 480 into contact with the closed end portion 534 so that the planar surface 502 is spaced from the end surfaces S42 of the annular U-shaped member 528 a distance of between about 0.005 and 0.015 inch. In response to a signal from the data processing unit 130, a current is then passed through the ring shaped electric-coil 530 to produce a magnetic force tending to attract the annular armature 498 toward the annular U-shaped member 528 which movement is prevented by the contact between the redraw sleeve 480, the closed end portion 534 and the outer surface S36. The magnetic force on the annular armature 498 is transmitted to the redraw sleeve 480 so that the redraw sleeve 480 applies a pressure against the portion of the closed end portion 534 as described above.

Figure 25:
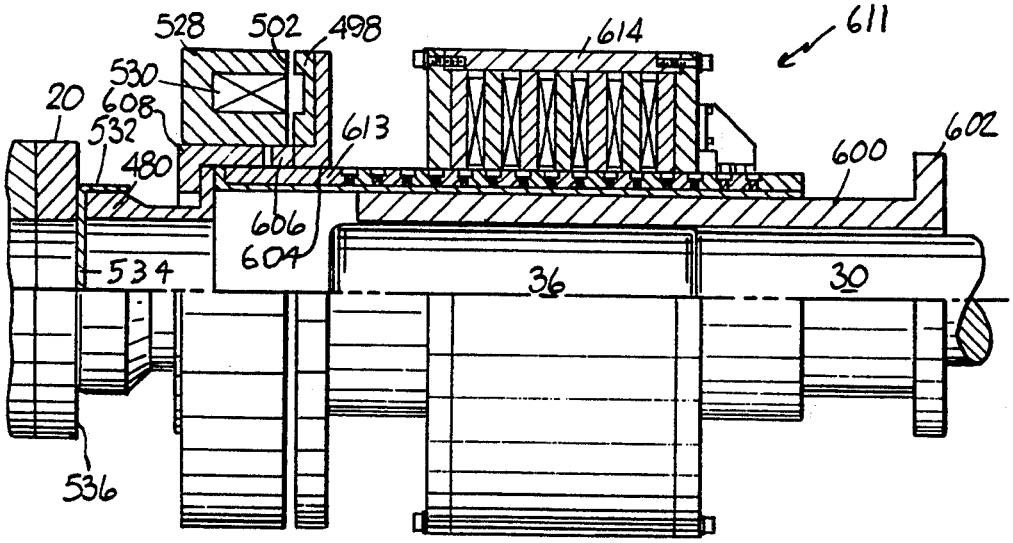
FIG. 25 is a top plan view with parts in section of another preferred embodiment of the invention with the redraw sleeve being urged against a portion of the can body preform.

Another preferred embodiment of the invention is illustrated in FIG. 25 in which an electromagnetic linear motor 611 is used to move the redraw sleeve 480 into contact with the closed end portion 534 so that the planar surface 502 is spaced from the end surfaces 542 a distance of between about 0.005 and 0.015 inch. The movable armature 613, as described below, is mounted for sliding movement over a guide sleeve 600 having a flange portion 602 for mounting on the support bracket 430. The annular armature 498 is threaded onto the threaded end portion 604 of the movable armature 613 and is secured in place by a lock nut 606. A flanged nut 608 holds the redraw sleeve 480 on the threaded end portion 604. In response to a signal from the data processing unit 130, a current is passed through the ring shaped electric coil 530 to produce a magnetic force tending to attract the annular armature 498 toward the U-shaped member 528 which movement is prevented by the contact between the redraw sleeve 480, the closed end portion 534 and the outer surface 536. The magnetic force on the annular armature 498 is transmitted to the redraw sleeve 480 so that the redraw sleeve applies a pressure against the portion of the closed end portion 534 as described above.

In FIGS. 26–32, there is illustrated, an improved electromagnetic linear motor, generally designated by the reference number 610 for moving the redraw sleeve 480. The improved linear motor 610 comprises a movable, cylindrically shaped armature 612 and a coaxial fixed stator assembly 614. The relation between "fixed"

and "movable" is, of course, reversible. The linear motor 610 utilizes both the constant magnetic flux generated by a plurality of permanent magnet rings 616, and the controllable magnetic flux generated through the use of electromagnetic coils 618, to produce translatory motion of the armature 612 relative to the stator assembly 614.

In accordance with the present invention, and with specific reference to FIGS. 26 and 27, the armature 612 comprises a non-magnetic tubular sleeve 620 which underlies and supports thereon a plurality of the permanent magnet rings 616 and axially spaced-apart inverted "T"-shaped rings 622 of ferromagnetic material. These inverted "T"-shaped rings 622 provide salient poles for the armature 612, the function of which will be described in greater detail below. An axially polarized permanent magnet ring 616 is situated between each adjacent pair of armature salient poles 622, wherein each permanent magnet ring 616 is oppositely polarized with regard to each adjacent permanent magnet ring. The permanent magnet rings 616 cooperatively produce a varying intensity magnetic field in an air gap 624 between the armature 612 and the stator assembly 614, which interacts with a translating magnetic field wave produced by the electromagnetic coils 618 within the stator assembly 614 to linearly move the armature 612 relative to the stator assembly. The inverted "T"-shaped rings 622 and the adjacent permanent magnet rings 616 form a magnetic sleeve surrounding the underlying armature tube 620.

The stator assembly 614 comprises a housing 626 which supports therein a series of alternating iron disc spacers 628 and electromagnetic coils 618 which are radially spaced from and surround the armature 612. The stator housing 626 includes a pair of disk-like end flanges 630 which are connected to an outer steel cylinder 632 by bolts 634. Each of the end flanges 630 includes an axially protruding ring member 636 which supports thereon a non-magnetic sleeve guide bearing 638 which contracts the outermost surfaces of the armature 612, and particularly the upper surfaces of the armature salient poles 622. The sleeve guide bearings 638 serve to guide and control the radial centering of the armature 612 within the stator assembly 614 and to resist decentering magnetic forces which are produced if the armature is allowed to become eccentric within the air gaps 624.

The iron disk spacers 628 within the stator housing 626 provide a plurality of axially spaced apart salient poles for the stator 614. The axial spacing between adjacent stator salient poles 628 is one-third greater than the axial spacing between the armature salient poles 622. This difference in pitch allows the stator 614 to develop forces on the armature 612 by the interaction of the permanent magnet field in the armature and an electromagnetic field in the stator. An electromagnetic coil 618 is situated between each adjacent pair of stator salient poles 628. The stator salient poles 628 and the electromagnetic coils 618 are all radially spaced from and extend circumferentially around an adjacent portion of the armature 612. With the axial spacing or pitch of the stator salient poles 628 being one-third greater than the axial spacing between the armature salient poles 622, six electromagnetic coils 618 are utilized to develop the translating magnetic field wave in the stator 614, to cause the desired translatory motion of the armature 612.

A bracket 640 is attached to the stator housing 626 by means of secondary bolts 642, for positioning several Hall-effect sensors 644 relative to the stator 614 that are activated by the passage of the permanent magnet field of the armature 612.

Figure 28:
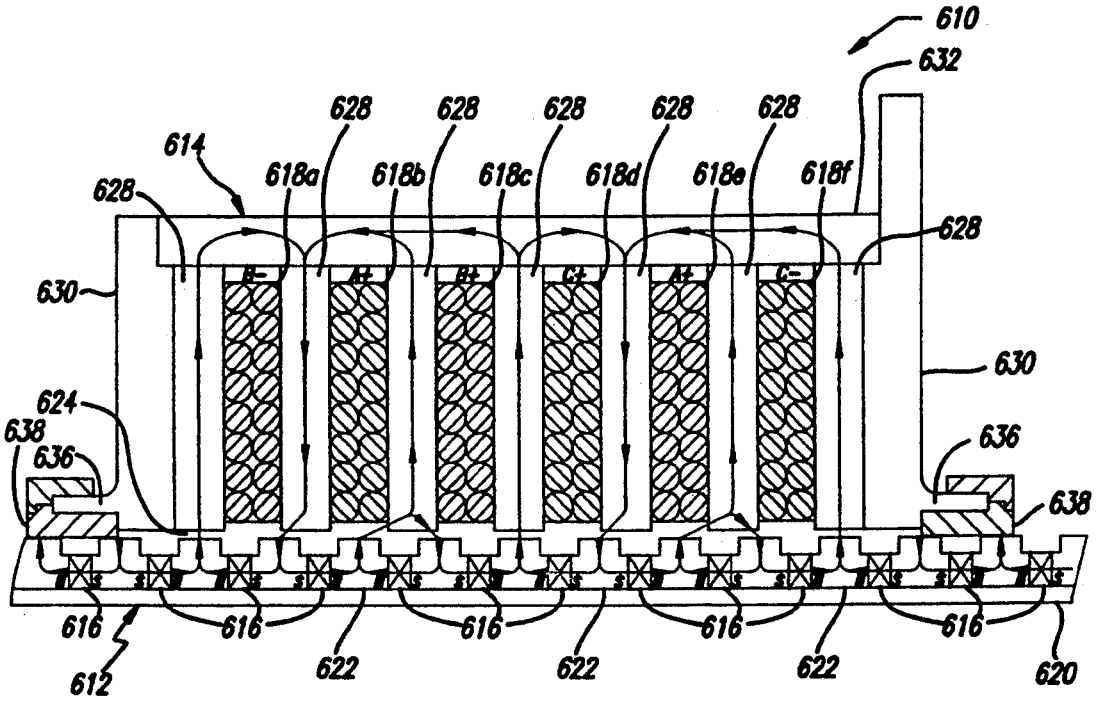
FIG. 28 is a fragmented sectional schematic view similar to the upper half of the linear motor illustrated in FIG. 2, showing the net magnetic flux generated by the permanent magnets and the electromagnets when the armature is in a first primary position relative to the stator.
Figure 29:
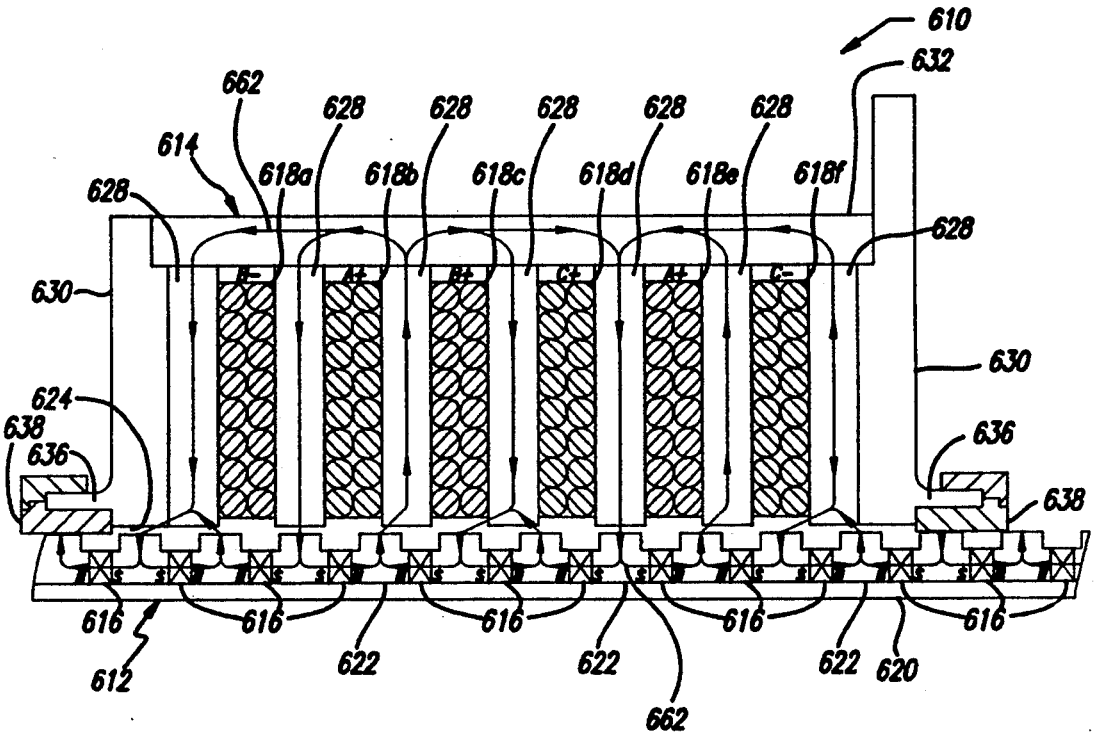
FIG. 29 is a schematic fragmented sectional view similar to that illustrated in FIG. 28, showing the net magnetic flux generated by the permanent magnets and the electromagnets when the armature is in a second primary position relative to the stator.

With reference now to FIGS. 28–30, the six electromagnetic coils 618 are connected in three primary pairs, wherein each pair of electromagnetic coils has a 120 degree current phase difference with respect to the other two primary pairs of electromagnetic coils, when energized. Numbering the coils left to right, the first coil **618*a* is paired with the third coil 618*c*, and these two electromagnetic coils are connected to one another so that the first coil generates a magnetic field having an opposite polarity compared with the magnetic field generated by the third coil 618*c*. The second electromagnetic coil 618*b* is paired with the fifth electromagnetic coil 618*e*, and this second pair of electromagnetic coils are connected to one another so that the second electromagnetic coil 618b and the fifth electromagnetic coil 618e both generate a magnetic field having the same polarity. The fourth electromagnetic coil 618*d* is paired with the sixth electromagnetic coil 618*f*, and these two electromagnetic coils are connected to one another so that the fourth electromagnetic coil 618*d* develops a magnetic field having an opposite polarity with the magnetic field developed by the sixth electromagnetic coil 618*f***, when energized.

A three-phase delta connection 646 (FIG. 31) is utilized to sequentially energize the electromagnetic coils 618. In FIGS. 28–32, the first pair of coils **618*a* and 618*c* are represented by the letter "B", the second pair of electromagnetic coils 618*b* and 618*e* are represented by the letter "A", and the third pair of electromagnetic coils 618*d* and 618*f* are represented by the letter "C". The three junctions 648 in the three phase delta connection 646 are connected to both the power source 650 and a ground 652. A source switch 654 controls electrical current flow between the power source 650 and each junction 648, and a sink switch 656 controls the flow of electrical current between each junction 648** and the grounds, in a standard manner.

FIG. 32 illustrates the phasing, polarity and intensity of the electrical current to the three primary coil pairs A, B and C as controlled by the three phase delta connection 646. This information is represented by the sinusoidal lines **658*a–c* as a function of time. It will be noted that all of the electromagnetic coils 618 are energized continuously with sinusoidally varying currents having changing phases and polarity, to generate magnetic flux within the stator 614 which interacts with the permanent magnetic flux in the armature 612 at the facing surfaces of the armature salient poles 622 and the stator salient poles 628**, to maximize thrust of the armature relative to the stator in a desired direction.

The time line in FIG. 32 has been divided into 7 equal segments **660*a–g*, wherein the phasing, intensity and polarity of the current through the electromagnetic coils 618 is the same in segments 660*a* and 660*g*, showing the repeating nature of the current source to the coils. It takes three of the time segments 660 to move the armature 612 axially a distance equivalent to the spacing between two adjacent armature salient poles 622. In this regard, FIG. 28 schematically illustrates the flux paths 662 of the magnetic flux generated by both the electromagnetic coils 618 and the permanent magnets 616 during the second time segment 660*b*. Likewise, FIG. 29 illustrates the flux paths 662 of the magnetic flux generated by both the electromagnetic coils 618 and the permanent magnets 616 during the third time segment 660***c*. Moreover, FIG. 30 illustrates the flux paths 662 of the magnetic flux generated by both the electromagnetic coils 18 and the permanent magnets 616 during the fourth time segment 660*d*. Axial forces are generated on the armature 612 by the interactions of the permanent magnet field wave and the electromagnet field wave. The axial force is produced by reluctance forces between the facing armature salient poles 622 and the stator salient poles 628.

With reference again to FIGS. 28–30 the coil connections and relative polarity of the connected electromagnetic coil pairs 618 are indicated by the letters A+, B+, C+ and C−. All of the electromagnetic coils 618 are energized continuously with sinusoidally varying currents that are phased properly to increase flux in the facing salient poles 622 and 628 which are in position to generate maximum force in the desired direction. In FIGS. 28–30, the armature is being moved to the right, relative to the stator. Conversely, the electromagnetic coils 18 driving the stator salient poles 628 that would produce counterproductive forces are energized with reversed polarity that diminishes the permanent magnet flux, and thus maximizes the efficiency of the force production by having all coils operating simultaneously.

The electromagnetic coils 618 are at all times either adding flux to the stator salient poles 628 oriented in a position to develop forces relative to the flux generated by the permanent magnet rings 618 through the armature salient poles 622 in the desired direction, and diminishing force in the salient poles that would resist the desired output force. Stated somewhat differently, the electromagnetic coils 618 are arranged and connected within the stator 614 to generate additional magnetic flux having the same polarity as magnetic flux generated by the permanent magnet rings 616 between facing armature and stator salient poles 622 and 628 positioned to move the armature relative to the stator in a desired direction. Further, additional magnetic flux is provided by the electromagnetic coils 618 having an opposite polarity as the magnetic flux generated by the permanent magnet rings 616 between facing armature and stator salient poles 622 and 628 positioned to resist movement of the armature 612 relative to the stator 614 in the desired direction.

With reference once again to FIGS. 31 and 32, the switching function of the three phase delta connection 646 will now be described with reference to the three junctions 648. A first such junction 648*a* connects the "A" coils to the "B" coils, a second junction 648*b* connects the "B" coils to the "C" coils, and a third junction connects the "C" coils to the "A" coils. During time segments 660*a* and *g*, the B sink and C source switches are opened, and both the A source and sink switches are opened. During time segment 660*b*, the A and B sink switches 656 are open and the C and B source switches are open. During time segment 660*c* the A and C sink switches are open and the B and C source switches are open. During time segment 660*d* the C and A sink switches are open and the B and A source switches are open. During time segment 660*e*, the C and B sink switches are open and the A and B source switches are open. Finally, during time segment 660*f*, the B and C sink switches are open and the A and C source switches are open.

In theory, the stator electromagnetic field can be caused to translate axially by (1) a sequential stepper control circuit that progressively energizes the coils 618 in the stator 614, (2) a contacting commutator or electrically conductive bars on the armature 612 that transmit information on armature position through sliding brush contact with electrically conductive brushes attached to the stator 614, or (3) use of non-contacting commutation means such as the multiplicity of Hall-effect sensors fixed relative to the stator 614 that are activated by the passage of the permanent magnet field of the armature 612 or by an axial position encoder either of the inductive, electrical contacting or optical type. Translating the stator magnetic field will produce forces on the armature 612 and continuous motion if the commutation signal is used to sequentially energize the coil sets in the manner above described to propel the armature 612 in the desired direction. The commutation and coil energizing function can be provided by servo control electronics that use the commutation signal in a closed loop feed-back type control.

The lines 664 in FIG. 32 illustrate the Hall-effect sensor signals generated during the various time segments 660*a–g*. The Hall-effect sensors 644 are used to determine when the torque curve 658 is positive for each of the phases. These sensors 644 provide digital signals that are 120 electrical degrees apart. The sensors 644 are sensitive to the direction of magnetic field originating from the permanent magnet rings 666 on the armature 612. The logical combination of these three signals define six repeating patterns representing precise locations of the armature 612 movement relative to the stator 614. In each of these locations a certain current circulation must be respected in order to achieve a consistent motor force in a given direction.

From the foregoing it is to be appreciated that the improved linear motor 610 is highly producible and inexpensive to manufacture from commercially available standard material forms rather than specialty parts which tend to be very expensive. The design of the linear motor 610 is spatially compact and electrically efficient producing a high force with relatively low moving mass of the armature parts. The armature 612 may be moved in either direction through the coaxial stator assembly 614 by simply reversing the current flow through the electromagnetic coils 618. A representation of current flow versus time in such a condition, moving the armature in FIGS. 28–30 to the left relative to the stator assembly 614, would be a mirror image of the graph of FIG. 32.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Can body making apparatus for forming can body preforms into elongated can bodies comprising:

a stationary support frame;

a housing having forming and ironing dies located therein mounted on said support frame;

a redraw assembly located adjacent to said housing;

an elongated ram having a longitudinal axis, a first end portion and a second end portion, said first end portion having an outer surface adapted for movement into said redraw assembly to contact a can body preform in said redraw assembly and to move said can body preform out of said redraw assembly and through said forming and ironing dies to form an elongated can body;

reciprocating drive means for providing reciprocating axial displacement for said elongated ram;

said redraw assembly having a redraw sleeve for contacting a can body preform;

said redraw sleeve having a longitudinal axis in alignment with said longitudinal axis of said elongated ram;

redraw carriage means for supporting and axially displacing said redraw sleeve relative to said elongated ram;

first electromagnetic coil means mounted at a fixed location adjacent to said housing and having a central coil axis in alignment with said longitudinal axis of said redraw sleeve for selectively providing an electromagnetic field for urging said redraw carriage means toward said housing;

second electromagnetic coil means mounted at a fixed location and having a central coil axis for selectively providing an electromagnetic field;

said redraw carriage means located between said first and second electromagnetic coil means;

control means having a first portion to operate said first and second electromagnetic coil means to move said redraw sleeve toward said housing and into said can body preform and move said can body preform against a portion of said housing and apply a pressure on said can body preform; and said control means having a second portion to operate at least one of said first and second electromagnetic coil means to control the amount of pressure applied by said redraw sleeve on said can body preform.

2. The invention as in claim 1 and further comprising:

said control means having a third portion to operate said first and second electromagnetic coil means to move said redraw sleeve in a direction away from said housing.

3. The invention as in claim 2 and further comprising:

a force applying member mounted on said redraw carriage means to permit reciprocal axial movement of said force applying member relative to said redraw carriage;

force applying means for applying a force on said force applying member and therefore on said redraw carriage and said redraw sleeve to apply said pressure on said can body preform; and said second portion controlling the amount of force applied to said force applying member.

4. Can body making apparatus for forming can body preforms into elongated can bodies comprising:

a stationary support frame;

a housing having forming and ironing dies located therein mounted on said support frame and having an abutment surface;

an axially reciprocal redraw sleeve assembly located adjacent to said housing;

an elongated ram having a longitudinal axis, a first end portion and a second end portion, said first end portion having an outer surface for movement into said redraw sleeve assembly to contact a can body preform between said housing and said redraw sleeve assembly and to move said can body preform through said forming and ironing dies;

reciprocating drive means for providing reciprocal axial displacement for said elongated ram;

said redraw sleeve assembly having a redraw carriage and a redraw sleeve;

said redraw sleeve having a longitudinal axis in alignment with said longitudinal axis of said elongated ram;

moving means for moving said redraw sleeve along said longitudinal axis toward said housing and into said can body preform to move said can body preform against said abutment surface;

electromagnetic clamping means having a longitudinal axis in alignment with said longitudinal axis of said elongated ram for applying a force on said redraw carriage to apply pressure on said can body preform;

said electromagnetic clamping means located adjacent to said abutment surface; and control means for controlling the amount of force on said redraw sleeve to control the amount of pressure on said can body preform.

5. The invention as in claim 4 and further comprising:

an annular armature formed from a magnetizable material mounted on said redraw sleeve and located close to but spaced from said electromagnetic clamping means when said redraw sleeve is located to apply pressure on said can body preform.

6. The invention as in claim 4 wherein:

said control means varying the amount of current supplied to said electromagnetic clamping means during the movement of said can body preform by said elongated ram to control the amount of force applied to said pressure applying means to control the amount of pressure applied by said redraw sleeve on said can body preform.

7. The invention as in claim 4 wherein said moving means comprise:

bearing means mounted at a relatively fixed location on said support frame;

at least a portion of said redraw sleeve mounted for sliding movement through said bearing means; and drive means for moving said redraw sleeve relative to said bearing means.

8. The invention as in claim 4 and further comprising:

a redraw assembly having redraw carriage means for supporting and axially displacing said redraw sleeve.

9. The invention as in claim 4 wherein said moving means comprise:

releasable clamping means for releasably clamping said redraw carriage means onto a portion of said elongated ram for movement therewith between a pressure applying location and a non-pressure applying location.

10. The invention as in claim 9 and further comprising:

shock absorbing means for stopping the movement of said redraw carriage means in one direction so that said pressure applying means are located at said pressure applying location to apply said pressure on said can body preform.

11. The invention as in claim 4 wherein said moving means comprise:

an electromagnetic linear motor.

12. Can body making apparatus for forming can body preforms into elongated can bodies comprising:

a stationary support frame;

a housing having forming and ironing dies located therein mounted on said support frame;

a redraw sleeve assembly located adjacent to said housing;

an elongated ram having a longitudinal axis, a first end portion and a second end portion, said first end portion having an outer surface for movement into said redraw sleeve assembly to contact a can body preform between said housing and said redraw sleeve assembly and to move said can body preform through said forming and ironing dies;

reciprocating drive means for providing reciprocal axial displacement for said elongated ram;

said redraw sleeve assembly having a longitudinal axis in alignment with said longitudinal axis of said elongated ram;

moving means for moving said redraw sleeve assembly toward said housing and into said can body preform to move said can body preform against at least a portion of said housing;

pressure applying means for applying a force on said redraw sleeve assembly to apply pressure on said can body preform;

control means for controlling the amount of force on said redraw sleeve to control the amount of pressure on said can body preform;

wherein said moving means comprise:

bearing means mounted at a relatively fixed location on said support frame;

at least a portion of said redraw sleeve mounted for sliding movement through said bearing means; and drive means for moving said redraw sleeve relative to said bearing means; and wherein said drive means comprise:

a servo motor; and connecting means for connecting said servo motor to said redraw sleeve to apply said forces thereto.

13. The invention as in claim 12 wherein said connecting means comprise:

a gear rack mounted on said redraw sleeve; and a gear mounted on said servo motor and in contact with said gear rack so that rotation of said gear moves said gear rack and therefore said redraw sleeve.

14. The invention as in claim 12 wherein said pressure applying means comprise:

electromagnetic coil means mounted at a fixed location, said electromagnetic coil means having a longitudinal axis in alignment with said longitudinal axis of said elongated ram; and an armature formed from a magnetizable material mounted on said redraw sleeve and located close to but spaced from said electromagnetic coil means when in location to apply pressure on said can body preform.

15. The invention as in claim 14 wherein:

said electromagnetic coil means is located between said bearing means and said housing.

16. The invention as in claim 14 wherein:

said bearing means is located between said electromagnetic coil means and said housing.

17. The invention as in claim 12 wherein said connecting means comprise:

a gear rack mounted on said redraw sleeve;

a rotatable shaft mounted at a relatively fixed location;

a gear mounted on said rotatable shaft and in contact with said gear rack; and drive means between said servo motor and said shaft to rotate said shaft.

18. Can body making apparatus for forming can blanks into elongated can bodies comprising:

a stationary support frame;

a housing having forming dies located therein mounted on said support frame;

an elongated ram member having a first end portion and a second end portion, said first end portion having an outer surface adapted for movement into a redraw assembly to contact a can blank supported on said redraw assembly and to move said can blank through said forming and ironing dies to form an elongated can body;

reciprocating drive means for providing reciprocating axial displacement for said elongated ram member; and a redraw assembly located adjacent to said housing, wherein said redraw assembly comprises:

a redraw sleeve;

redraw carriage means for supporting and axially displacing said redraw sleeve relative to said elongated ram;

an annular electromagnetic coil fixedly positioned relative to said stationary support frame for providing an axial force for holding said redraw carriage means at an axially forward position for abuttingly clampingly holding a can blank between said redraw sleeve and a portion of said housing prior to and during engagement of said can blank by said first end portion of said elongated member; and wherein, said ram member, during its axial displacement, passes through said annular electromagnetic coil.

19. In a can forming apparatus in which a cylindrical redraw sleeve holds a can material preform cup against a forming die while a ram pushes said cup through an opening in said die to form a can body, an improvement comprising;

means for reciprocating said redraw sleeve between a retracted position and an extended position;

said redraw sleeve being in said retracted position to allow placement of said can material preform cup against said die and in said extended position to hold said can material preform cup against said die;

an electromagnet mounted on said apparatus adjacent to said housing;

a ring of magnetic material mounted coaxially to said redraw sleeve so that said ring is adjacent to said electromagnet when said redraw sleeve is in said extended position.

20. Can body making apparatus for forming can blanks into elongated can bodies comprising:

a stationary support frame;

a housing having forming and ironing dies located therein mounted on said support frame;

an elongated ram member having a first end portion and a second end portion, said first end portion having an outer surface adapted for movement into a redraw assembly to contact a can blank supported on said redraw assembly and to move said can blank through said forming and ironing dies to form an elongated can body;

reciprocating drive means for providing reciprocating axial displacement for said elongated ram member;

a redraw assembly located adjacent to said housing, wherein said redraw assembly comprises: a redraw sleeve for supporting a can body preform thereon; redraw carriage means for supporting and axially displacing said redraw sleeve relative to said elongated ram; and redraw electromagnet means fixedly positioned relative to said stationary support frame for providing an axial force for holding said redraw carriage means at an axially forward position for abuttingly clampingly holding a can blank between said redraw sleeve and said housing prior to and during engagement of said can blank by said first end portion of said elongated ram member.

* * * * *